US007493709B2

(12) United States Patent
Trask et al.

(10) Patent No.: US 7,493,709 B2
(45) Date of Patent: Feb. 24, 2009

(54) SNOWSHOE

(76) Inventors: David V. Trask, 4495 S. Aspen Hollow La., Salt Lake City, UT (US) 84117-4615; Brian C. Trask, 3601 E. Hermes Dr., Salt Lake City, UT (US) 84124-3214; Valorie J. Downs, 15370 S. 1800 West, Bluffdale, UT (US) 84065; Renae L. Trask Schwartz, 2741 E. Juniper Way, Salt Lake City, UT (US) 84117

( * ) Notice: Subject to any disclaimer, the term of this patent is extended or adjusted under 35 U.S.C. 154(b) by 1260 days.

(21) Appl. No.: 10/466,498

(22) PCT Filed: Jan. 10, 2002

(86) PCT No.: PCT/US02/00898

§ 371 (c)(1),
(2), (4) Date: Jul. 7, 2003

(87) PCT Pub. No.: WO02/087372

PCT Pub. Date: Nov. 7, 2002

(65) Prior Publication Data

US 2004/0083626 A1 May 6, 2004

Related U.S. Application Data

(60) Provisional application No. 60/273,411, filed on Mar. 6, 2001, provisional application No. 60/260,972, filed on Jan. 10, 2001.

(51) Int. Cl.
*A43B 5/04* (2006.01)

(52) U.S. Cl. ..... 36/122; 36/125

(58) Field of Classification Search ..... 36/122–125
See application file for complete search history.

(56) References Cited

U.S. PATENT DOCUMENTS 4,620,375 A * 11/1986 Wallace ..... 36/7.6
4,720,928 A * 1/1988 Faber et al. ..... 36/122
5,309,652 A * 5/1994 Campbell ..... 36/124
5,459,950 A * 10/1995 Damm et al. ..... 36/122
5,901,471 A * 5/1999 Warner ..... 36/124

* cited by examiner

*Primary Examiner*—Marie Patterson
(74) *Attorney, Agent, or Firm*—Brian C. Trask

(57) ABSTRACT

An improved snowshoe (49, 138, 220) having a binding (105) attachable to a flotation platform (51). The snowshoe (49, 138, 220) may be adjusted to accommodate to changes in snow conditions and terrain while on a snowshoe excursion. Certain embodiments permit quick removal of the binding (105) from the platform (51) for use as a detached walking crampon (203). Certain platforms (51) may be adjusted in size to present a plurality of footprint sizes to ssnow.

17 Claims, 17 Drawing Sheets

SNOWSHOE

PRIORITY CLAIM

This application claims the benefit of the filing dates of the U.S. Provisional Patent Applications: Ser. No. 60/260,972, filed Jan. 10, 2001, for "Detachable binding for snowshoes" and Ser. No. 60/273,411, filed Mar. 6, 2001, for "Adjustable size snowshoe".

TECHNICAL FIELD

The invention pertains particularly to snowshoes. One aspect of the invention is directed to a binding carrying a crampon portion which may be decoupled from the snowshoe while remaining attached to footwear. Another aspect is directed to a length-adjustable snowshoe construction to change a size of a snowshoe flotation platform.

BACKGROUND

Hiking across snow is facilitated by the use of snowshoes. Snowshoes typically include bindings structured to fasten to the lower portion of footwear, usually a hiking boot. The binding is conventionally coupled to a flotation platform of the snowshoe in a fashion which permits the heel of the boot to lift as the wearer moves with a normal stride. That is, the binding is mounted to pivot with respect to the platform on an axis transverse the direction of the longitudinal axis of the platform. The toe portion of the boot is thereby permitted to drop beneath the lower surface of the snowshoe as the heel of the boot elevates. In this respect, snowshoe bindings differ from those used in connection with gliding sports, such as skiing and snowboarding.

Some snowshoes are constructed such that the binding pivots by distorting a flexible component of the flotation platform. Other snowshoes mount the binding to pivot around or with a rigid axle. Certain modem snowshoes connect the bindings to structural members of the snowshoe through pivot connections located at opposite sides of the hiker's foot. In any case, the boot toe digs into the snow, and contributes to the traction and stability of the snowshoe as the hiker proceeds along either hard packed or loose snow. This mode of operation is particularly advantageous as a snowshoe hiker proceeds uphill. As an additional assist, the toe portion of the binding may be provided with gripping fixtures so that the binding functions as a crampon device. This crampon feature enhances the ability of a snowshoe hiker to either ascend, descend, or traverse steep terrain.

Snowshoeing excursions generally include rest stops. Prolonged stops, such as lunch breaks are more relaxing with the snowshoes removed. It is a relatively common practice for a hiker to remove his snowshoes, and to use them as a seat, thereby providing a barrier between his clothing and the snow. Both attachment and detachment of snowshoes from a boot involves physical manipulations and exertions which require strength and balance. The effort, difficulty and time required to remove and to then reattach snowshoes in the field discourages many from doing so. They thus either remain standing, or simply accept the awkwardness attendant to sitting or squatting in the snow with their snowshoes attached to their feet.

It often occurs that as a hiker traverses a route, the conditions of the terrain vary between those which favor the use of snowshoes and those which would be better negotiated without snowshoes. In situations in which snowshoes are not required to maintain flotation, or to otherwise support the hiker, they tend to be cumbersome. Hard packed snow or ice, for example, is traversed with less effort in boots (with snowshoes removed), provided those boots offer sufficient traction. Unfortunately, standard hiking boots, even those designed for use in winter conditions, provide insufficient traction for the varied slippery conditions encountered by snowshoe hikers. In steep terrain especially, snowshoes are awkward to use on hard slippery surfaces. Conventional crampons are useful under those conditions, but snowshoe hikers rarely have them available. In any case, intermittently changing between snowshoes and crampons during a hike requires considerable effort; more than a typical hiker is generally willing to expend.

The bindings of conventional snowshoes are most often attached to the remainder of the snowshoe by lacings, rivets or other means, making them substantially integral components. In some instances, the bindings are connected to structural supports associated with a flotation platform (base) through pivot supports by means of rivets, bolts or pins. Such bindings are capable of removal for replacement or repair. This removal generally requires the use of tools, and is difficult to accomplish under harsh conditions in the field. In any case, disassembly of a snowshoe in the field is normally done on an emergency basis only; it involves an expenditure of time and energy beyond that which is acceptable for typical recreational hiking, except to effect repairs. Moreover, snowshoe bindings have not generally been constructed for independent use as crampons.

Crampons of various configurations are available. They generally comprise a sole plate, usually of metal, which may be attached, usually with straps, to the sole of a hiking boot. Structures depending from the sole plate are configured to dig into snow and/or ice to provide stable footing for a hiker. Mountaineering crampons are typically much more complex than are hiking crampons. The crampon bindings currently provided with snowshoes resemble hiking crampons.

An exemplary snowshoe and binding combination is disclosed by U.S. Pat. No. 5,531,035. FIGS. 1 and 2 of the '035 patent illustrate currently available arrangements which can be modified in accordance with this invention. Crampon bindings for snowshoes are described by U.S. Pat. Nos. 5,253,437 and 5,918,388; U.S. DES 429,513 and Published International Patent Application WO 00/62636.

One difficulty confronting snowshoe hikers is the generally cumbersome character of the snowshoes in transport and storage situations. Snowshoes are by nature somewhat bulky and ill suited for packing in car trunks, duffel bags, back packs and the like. If removed in the field, they are awkward to carry, particularly under circumstances in which the hiker requires the use of his hands. Another difficulty involves the fixed dimensions of most current snowshoes. It is the usual practice for a snowshoe hiker to be outfitted with snowshoes having a footprint regarded as appropriate for the weight class in which the individual hiker is classified. The size and shape of the snowshoes selected by an individual may reflect personal preferences, and may further be influenced by the conditions of use anticipated by that individual. The footprint preferred for deep fluffy snow will differ from that preferred for shallow or slushy snow, for example. Shorter snowshoes are generally preferred for packed snow, steep terrain and for downhill "skating." While many hikers accumulate multiple sets of snowshoes for use under different conditions, it is unusual for a hiker to carry more than one pair of snowshoes on any given excursion. There thus remains a need for a practical means whereby a hiker is enabled to adjust the footprint of a snowshoe in response to changing conditions of use.

The '035 patent recognizes the shortcoming of the invariable flotation characteristics offered by snowshoes generally. That patent discloses an ingenious snowshoe with variable flotation characteristics. The snowshoe of the '035 patent comprises a flotation plate and one or more extension members, each of which may be detachably coupled to the plate to increase its footprint (snow contact surface area.) While this development is excellent in concept, it does not fully resolve the problem. Most snowshoe structures do not utilize a flotation plate of the type required by the '035 patent. Moreover, in practice, the connection system of the '035 patent is somewhat difficult to use under field conditions. Greater adjustability would also be useful.

DISCLOSURE OF THE INVENTION

This invention can be viewed as an improved snowshoe assembly, which may include a detachable binding, ideally a quick-connect/quick-release crampon binding. It could alternatively be viewed as an improved crampon assembly, convertible to a snowshoe. It may also be viewed as a snowshoe capable of changing in size of flotation platform. According to one aspect of invention, a snowshoe binding is pivotally connected to the structural framework of a snowshoe by a quick-release connector system, thereby enabling selective coupling and decoupling of the binding with respect to the flotation platform of the snowshoe. Such a binding is ideally fashioned generally as a stand-alone crampon, which can be used as such apart from the snowshoe. In practice, a snowshoe hiker need merely attach the bindings of this invention to his hiking boots, and may thereafter selectively attach or detach snowshoe frames to the bindings as best suits the changing terrain or in response to other considerations. According to certain embodiments, a quick-release mechanism of this invention is integral with or permanently attached to a boot. It is also within contemplation for a quick-release mechanism of this invention to be adapted for use with a snowboard binding; whereby to permit a snowshoe hiker to step directly from his snowshoes to his snowboard.

As applied to snowshoes, the bindings of this invention are ideally constructed to approximate the configuration of a conventional hiking crampon. They will generally have an upper surface configured to interface with the bottom of a hiking boot suitable for use in the snow. They will typically further carry lacings, clamps, straps or other fixtures constructed and arranged to capture the foot portion, or the sole, of the boot or footwear. While it is within contemplation for the crampon to comprise an integral portion of the boot, (with the boot itself constituting means for attaching the flotation components of a snowshoe to a hiker's foot), it is currently preferred for the crampon to be provided as a separate structure, which can be attached to and detached from the boot at will. The lower surface of the binding is configured to bite into loose or hard packed snow or ice. Any of the configurations in use with conventional crampons can be applied to the bindings of this invention, although less elaborate configurations are currently preferred to minimize adhesion of snow to the binding.

The snowshoes of this invention can be constructed in typical fashion, with a substantially planar support base or flotation platform. This platform may comprise a continuous sheet; e.g., of metal or tough plastic. Other platform constructions comprise a rigid, peripheral support frame, typically of wood or tubular metal, anchoring flexible panels, straps or strands of webbing. The webbing may be of gut, synthetic or natural fibers, metallic cable or other suitable material. The front end of the platform usually curves upward, and in some instances, the tail end curves either upward or downward. Various traction-enhancing fixtures may be mounted to depend from the lower surface of the platform. Provision typically is made at a region between the longitudinal edges of the platform, normally somewhat forward of center, for the binding structure. The removable binding of this invention is located in conventional fashion, but can be connected to the flotation platform by means of a quick-release connection system.

The removable binding of this invention is applicable to nearly any snowshoe construction. Quick-release fixtures can be incorporated in snowshoe structures of virtually any design to connect bindings to a flotation platform. Moreover, the flotation platform of nearly any existing snowshoe can be retrofitted to incorporate the quick-release fixtures of this invention. It is also within contemplation to structure flotation platform elements for connection to conventional crampon devices.

A quick-release connection system of this invention may comprise a single mechanism operable to connect a binding to a platform or structure associated with a platform. According to certain preferred embodiments of this invention, inner (instep side) and outer connection fixtures are located at opposite sides of an attached binding. These fixtures may provide a pivot capability, or they may secure other structure which provides the pivot capability for the binding. When the snowshoe is attached to a boot, these connection fixtures are usually inherently positioned forward of the instep of the boot. The inner and outer fixtures may be substantially identical, but certain embodiments utilize somewhat different structures on opposite sides of the binding. In any event, the connection fixtures of this invention typically include a first component secured to (or integral with) the flotation platform of the snowshoe. They further include a second component secured to (or integral with) the binding. The first and second components are structured and arranged to permit reliable quick-release coupling and decoupling through simple manipulations, preferably even under adverse (such as freezing) weather conditions.

As used in this disclosure, the term "quick-release" is intended to contrast the connection fixtures of this invention with mechanisms which require removal of the snowshoe from a hiker's foot to effect a decoupling of the binding from the snowshoe. It is not practical, for example, to remove the rivets, pins and bolts of the pivot connections currently in use without first removing the snowshoes. Even then, the decoupling manipulations for such pivot connections require the use of tools, and generally impose the necessity for keeping track of removed small parts (pins, bolts, etc.) The quick-release connection fixtures of this invention can sometimes be operated either to couple or decouple the binding from a snowshoe without removal of the binding from the boot (or foot) of the hiker. Such coupling and decoupling can also be referred to as providing "step-in" and "step-out" capability, respectively. While operation of some embodiments of this invention might be assisted by the use of a small tool; e.g., a screwdriver or ski pole tip, such embodiments arc not currently preferred.

However, certain embodiments of quick-connect or quick-release fixtures within the ambit of the present invention may best be operated with the binding being separated from footwear. Certain of such embodiments include latching components (e.g. stub axles, or latch hooks) which are biased toward a retaining or capture position with respect to cooperating connection structure. Attachment of a binding to a boot may even effectively prevent coupling or decoupling of certain connection fixtures. In any case, quick-connect or quick-release fixtures according to the present invention will be arranged for all structure associated with the connection to remain attached to a binding or platform. Such an arrangement effectively precludes loss of connection hardware.

Varied connection fixture structures are operable, provided they provide for pivotal movement of a boot secured by the binding on a pivot axis transverse to an axis roughly parallel to the longitudinal axis of the base support, or snowshoe flotation platform. This pivot axis may intersect the longitudinal axis of the snowshoe, but is typically spaced slightly, either above or below, from a plane containing the longitudinal axis. In most instances, when the hiker stands erect atop snowshoes mounted to his boots, the sole of each boot rests approximately parallel the upper surface of the base support (frame or flotation platform) of the associated snowshoe, atop a bottom (sole) plate (or similar structure) of the binding. The sole plate will usually be located such that its tail (or heel) end bears upon the upper surface of the flotation platform during the weight-bearing portion of each step. The presently preferred connection fixtures provide for "step-in" coupling; that is, coupling is effected by merely properly positioning the sole plate (which may by connected to the hiker's boot); and then moving the plate or other structure slightly to place the plate into "captured" condition. The required movement may be in any direction, as established by the design details of the fixture. Decoupling may be effected by an equally uncomplicated maneuver, usually comparable to opening a latch, thereby permitting removal of the binding plate from its captured condition. As used in this disclosure, the term "sole plate" refers to any structure adapted to support a boot sole in a binding, including in some instances, the boot sole itself. That structure is considered to be in a "captured" condition whenever the binding is held by the fixture to establish a pivot axis, for a foot within the binding, in relation to a snowshoe.

The flotation platform of this invention can also be length-adjustable. One such platform includes a plurality of segments, including a binding segment and one or more extension segments. The extension segments may be coupled together, sometimes in various relative positions, to build a snowshoe assembly having a selected footprint. The binding segment has a relatively small footprint, and may itself function as a small snowshoe, or crampon device. It may include the entire front portion of the snowshoe as an integral component. Preferably, however, the binding segment is structured to receive a detachable forward extension segment. Ideally, a short detachable front nose piece is interchangeably connected to either the binding segment or a forward extension segment. One or more rear extension segments may be detachably connected to the trailing end of the binding segment. Additional rear extension segments may be added as needed to the trailing end of previous extensions. The trailing end of such an assembled snowshoe ideally terminates in an interchangeable tail element. The installation of extension segments correspondingly establishes a desired enlarged footprint for the assembled snowshoe. Ideally, extension segments may be interchangeably used at either the front or rear of the snowshoe assembly.

The binding segment ordinarily includes approximately parallel side supports. Each extension segment also carries structures which register with these side supports when the extension is juxtaposed with the binding segment. The terminations of these registered elements of the binding segment and extension segment are structured and arranged to couple together, thereby extending the footprint of the snowshoe. A presently preferred arrangement utilizes structural tubing for the side supports and extension structures. The diameters of the respective tubing elements may be selected to accommodate a "plug in" or telescoping connection. Latching fixtures carried by the binding segment and the extension segment secure the connection. Additional extension elements may be added in similar fashion.

Latching members may comprise any mechanical device capable of securing adjacent segments of the snowshoe assembly together. When segments are connected by a concentric (telescoping) tubing construction, detents or mechanical latch mechanisms are operable. Each segment will usually include one or more transverse structural members, which provides a convenient anchoring point for a buckle or strap. One such connection near the longitudinal axis of the assembly is usually sufficient to secure concentric tubular connections at the edges of joined segments. Other suitable latching members include collet joints, threaded connectors and friction joints.

The dimensions of the components of the snowshoes are not critical to the applicability of the invention. Nevertheless, most currently available snowshoes are offered in a variety of sizes within a practical range. The snowshoes of this invention will generally fit within that range, no matter how many extension segments are included in the assembly. A practical embodiment of a snowshoe of this invention may include a binding segment approximately seven to 10 inches wide, and of relatively short length, typically about 10 to about 20 inches. While this invention may be accommodated to snowshoes of any desired shape, approximately parallel, straight sides are generally preferred. Extension segments are most conveniently similar in width to the binding segment, and may be of any desired practical length; e.g., about 2 to about 12 inches. Terminal nose and tail segments may be contoured in conventional or exotic configurations, and are usually only as long as required to accommodate those configurations.

Other length-adjusting expedients are within contemplation. For example, one alternative embodiment telescopically extends concentrically loaded tubing rearwardly from the side supports of the binding segment, thereby expanding the perimeter of the footprint. As the length of the snowshoe frame is extended, a portion of the flotation platform is moved back from the binding segment. A pre-folded or rolled platform element may be positioned near the trailing end of the binding segment such that as the perimeter of the platform is enlarged, decking is inherently positioned to provide a true flotation surface for the expanded footprint. Another alternative connects an extension segment to the rear of the binding segment so that it can selectively be swung up towards a vertical orientation or down to a substantially horizontal orientation, thereby increasing the footprint of the snowshoe.

These features, advantages, and alternative aspects of the present invention will be apparent to those skilled in the art from a consideration of the following detailed description taken in combination with the accompanying drawings.

BRIEF DESCRIPTION OF THE DRAWINGS

In the drawings, which illustrate what currently are considered to be the best modes for carrying out the invention.

BEST MODE FOR CARRYING OUT THE INVENTION

Reference will now be made to the drawings in which the various elements of the invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
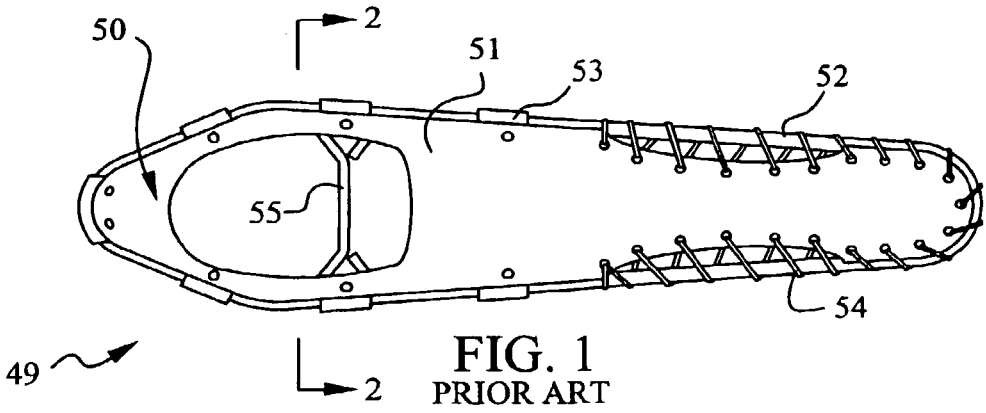
FIG. 1 PRIOR ART
FIG. 1 is a plan view of a known type of snowshoe which pivotally mounts a binding (not shown) to a transverse binding axle.
Figure 2:
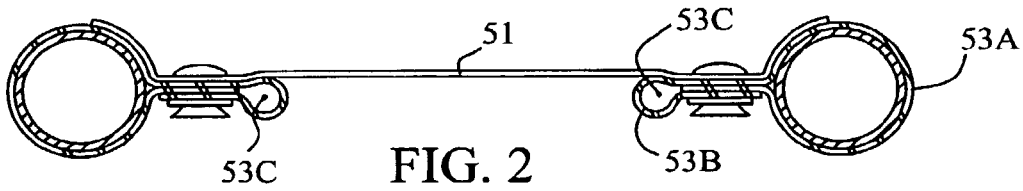
FIG. 2 PRIOR ART
FIG. 2 is a view in cross section of the snowshoe of FIG. 1, taken along the reference line 2-2, as viewed in the direction of the arrows.
Figure 3:
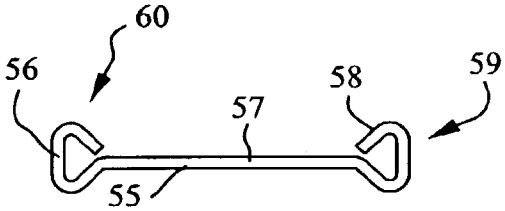
FIGS. 3 and 3A are plan views of axle components typical of snowshoes of the type illustrated by FIG. 1.

FIGS. 1 through 3 illustrate a common snowshoe structure 49 of the type currently marketed by Yukon Charlie's of Buzzards Bay, Mass. Similar structures are marketed by others under the trademark "TUBBS." A flotation platform, generally 50, comprises a flexible panel or deck 51 anchored to a peripheral frame 52 by a plurality of resilient deck straps 53 and lacing 54. For purposes of this disclosure, the term "flotation platform" 50 is used broadly to include structure inherently associated with, or attached to, a deck 51. The term "deck" is sometimes used interchangeably with the term "platform."

Figure 3A:
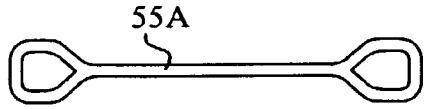

An axle element, generally 55 (FIG. 3) or 55A (FIG. 3A) is anchored to the frame 52 by two of the anchoring straps 53A (FIG. 2), each of which is configured with a loop 53B beneath the platform 51. Each such loop 53B engages a longitudinal member 56 of the axle 55 inside a space 53C. The axle 55 also includes a transverse shaft member 57, connected to opposing longitudinal members by forked extension members 58.

The terms "longitudinal" and "transverse," as used in this disclosure, are intended to indicate approximate directions, taken with reference to the direction of the longitudinal axis of a snowshoe. A "forward" direction corresponds to a vector oriented from a heel or "rear" toward the toe of a snowshoe. The terms "lateral" and "transverse" may at times be used interchangeably.

The fork members 58 and longitudinal members 56 of the axle 55 form "D" ring terminations 59, 60 at opposite ends of the transverse shaft 57. The "D" rings 59, 60 are illustrated in one of any number of available configurations. Prior art snowshoes, such as illustrated in FIG. 1, conventionally mount a binding (not shown) to pivot on the transverse shaft 57 of the axle 55. The mounting mechanism (not shown) is permanent, in the sense that tools and significant effort are required to remove them from the axle.

FIGS. 4 through 22 illustrate various structural arrangements whereby quick-release mechanisms or fixtures within the scope of this invention may be utilized to couple binding axles 55 to flotation platforms, thereby to assemble snowshoes equivalent to the type illustrated by FIG. 1. Certain embodiments of the invention therefore allow a quick-and easy detachment of the axle/binding assembly at the axle-to-platform interface. Many other mechanically equivalent quick-release mechanisms are within the skill of designers of latch mechanisms and snowshoes. Moreover, generally similar mechanisms can be adapted for use with bindings which do not incorporate an integral transverse shaft 57. As illustrated by FIGS. 4 through 22, however, bindings which include an integral binding shaft 57 are assumed, and each of the embodiments of FIGS. 4 through 22 effects a quick-release coupling between a platform and such a shaft. Similar mechanisms are operable in snowshoes structured with a transverse binding shaft associated with the platform, rather than with the binding (as illustrated by FIG. 1). For such applications, a somewhat different placement of the components of the quick-release mechanism may be required. Similar mechanisms may also be adapted for use with snowshoe structures which avoid the use of a continuous transverse binding axle in favor of equivalent pivot axle structures. For example, generally similar release mechanisms may be adapted to couple bindings to stub shafts carried by either the removable binding or the platform; they may also be adapted to couple bindings to a flexible platform component other than a pivot shaft.

Figure 4:
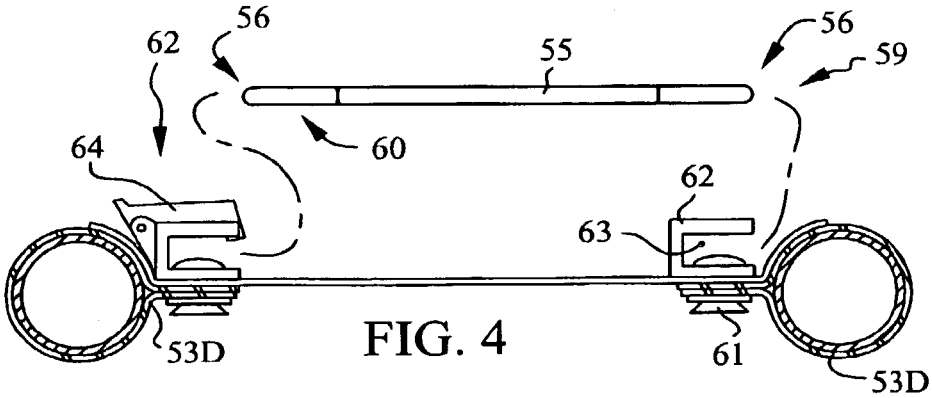
FIG. 4 is a view in elevation, partially in section, of an axle component in association with a snowshoe carrying connection fixtures of the invention.
Figure 5:
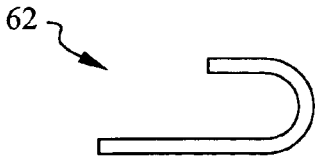
FIG. 5 is a view in elevation of a simple connection fixture of the invention.
Figure 6:
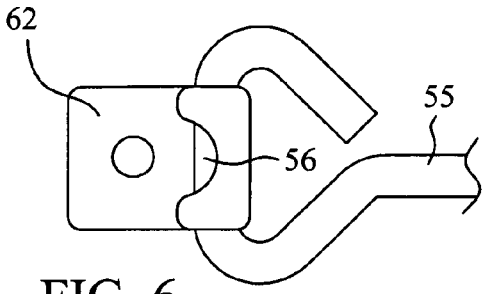
FIG. 6 is a plan view of the fixture of FIG. 5 with a "D" ring portion of a binding axle in captured condition.

FIG. 4 illustrates an arrangement in which the conventional straps 53A are replaced by straps 53D. Suitable fasteners 61 anchor quick-release mounts 62. The axle 55 is positioned with its opposed longitudinal members 56 within respective channels 63 of the mounts 62, being held in place by a retainer member 64 associated with at least one of the mounts 62. FIGS. 5 and 6 illustrate a simple version of a suitable such mount 62, FIG. 6 showing a longitudinal member 56 of the axle 55 captured within the channel 63 such that upward movement is restrained by the upper panel 65 of the mount 62. The axle 55 may be held in place with a single retainer device 64 associated with one of the mounts 62. That is, end 59 may be retained with a passive fixture 62, while opposite end 60 is retained by an active fixture, e.g. mount 62 and retainer 64. It is within contemplation that active retaining fixtures may be provided at both ends 59, 60 of the axle, however.

Figure 7:
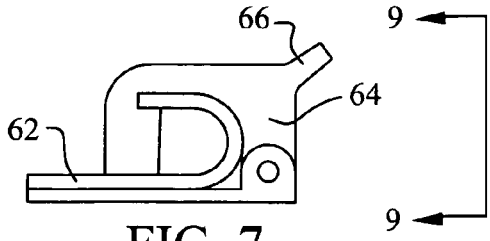
FIG. 7 is a view in elevation of a fixture similar to that of FIG. 5, but including a retainer element.
Figure 8:
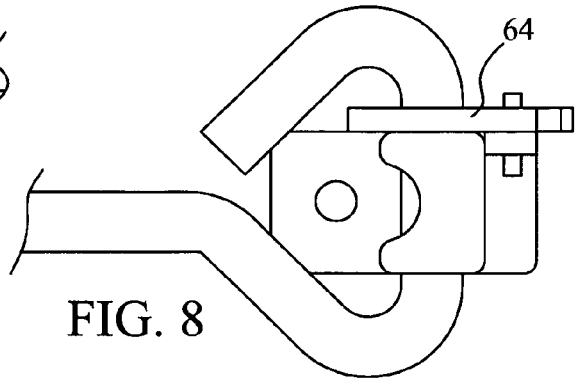
FIG. 8 is a view similar to FIG. 6 of the fixture of FIG. 7.
Figure 9:
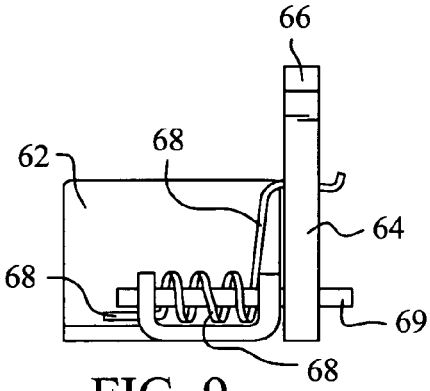
FIGS. 9 and 10 are views in elevation of fixtures similar to that of FIG. 7, illustrating alternative bias mechanisms.
Figure 10:
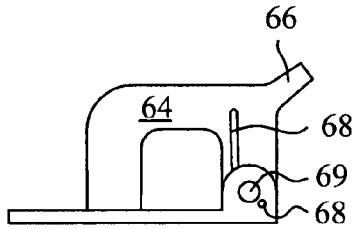

FIGS. 7 and 8 illustrate a simple toggle retainer in closed condition to restrain transverse movement of the axle 55 from the channels 63. The retainer 64 can be opened to release the longitudinal member 56 by pressing on the lever 66. While the retainer 64 may be biased towards its closed condition; e.g., as illustrated by FIGS. 9 and 10, it will function adequately without biasing, provided the pivot pin 67 provides sufficient frictional resistance to avoid opening during walking motion. Exit force by the axle 55 is inherently applied upon the retainer 64 in a position tending to urge the retainer into closed condition. Spring biasing may be provided in conventional fashion, as by the torsion spring 68 acting about axle 69 (FIG. 9), if desired.

The mount 62 may be fashioned of any rigid material, such as metal or plastic. It may further be lined or coated with other materials to provide for close tolerances and/or cushioning to reduce noise generation, and to provide a lubricant. A Nylon (or comparable synthetic material) block with a properly dimensioned channel 63 is sometimes preferred.

Figure 11:
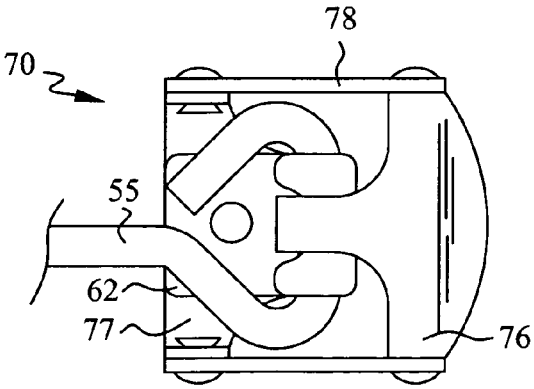
FIG. 11 is a view similar to FIG. 8, illustrating an alternative buckle retainer mechanism.
Figure 12:
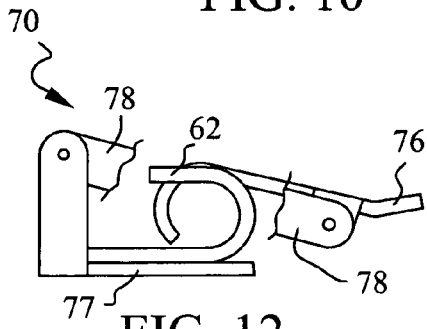
FIG. 12 is a fragmentary view in elevation of the embodiment of FIG. 11.

FIGS. 11 and 12 illustrate an alternative arrangement in which a longitudinal axle member 56 is secured within a mount 62 by means of a buckle retainer, generally 70. A buckle lever 76 is suspended from a buckle base 77 by a pair of arms 78. A closed buckle 70 may bias an axle 55 into registration with a quick-release mount 62 to prevent rattling of the axle 55 inside the mount 62.

Figure 13:
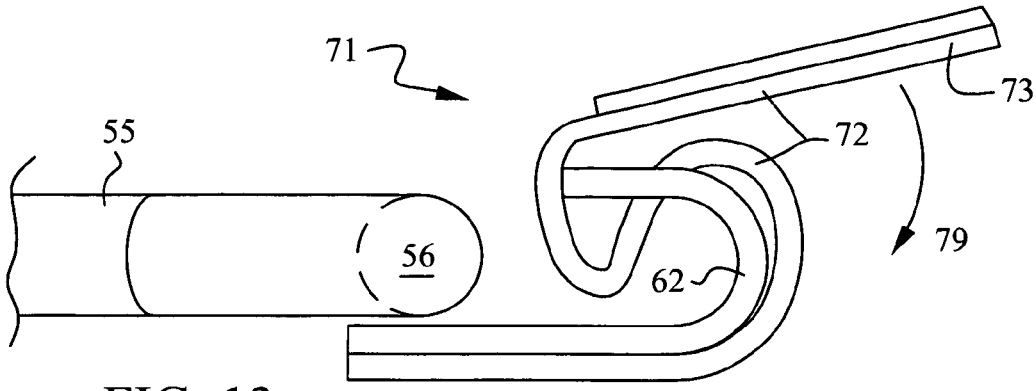
FIG. 13 is a view in elevation of an alternative embodiment utilizing a spring release retainer element.
Figure 14:
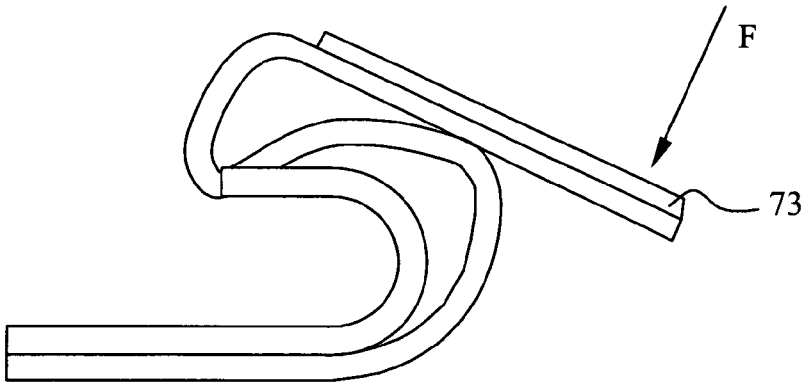
FIG. 14 illustrates the release element of FIG. 13 in open condition.
Figure 15:
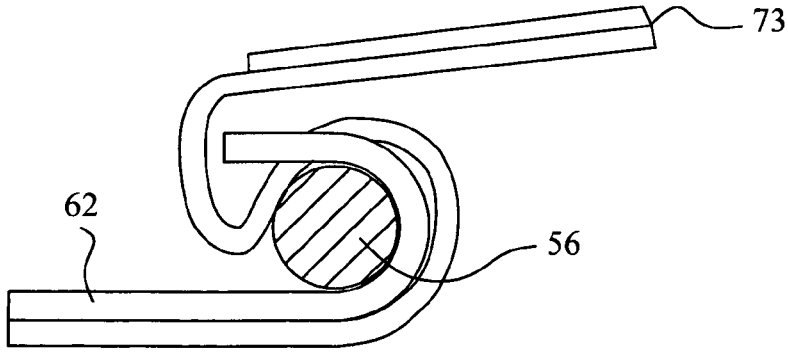
FIG. 15 illustrates the release element of FIG. 13 in closed condition, with a portion of a captured axle member shown in cross section.

FIGS. 13, 14 and 15 illustrate another alternative release retainer mechanism, generally 71, fashioned as a spring element 72. FIG. 14 shows the spring element 72 forced into open condition by means of force F applied to the lever portion 73. FIG. 15 shows the spring element 72 in its retaining condition, capturing the axle member 56. Such a retainer 71 is actuated for assembly of a binding to a flotation platform simply by sliding a foot laterally, or with the assist of pressing the lever 73 in the direction indicated by arrow 79. Of course, mechanisms such as retainer mechanism 71 may also be adapted (by rotation of mounted orientation on a flotation platform) to engage a transverse portion of retained structure, such as an axle.

Figure 16:
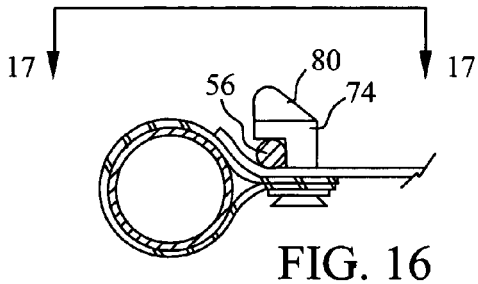
FIG. 16 is a view in elevation of an alternative embodiment utilizing a turn buckle retainer element.
Figure 17:
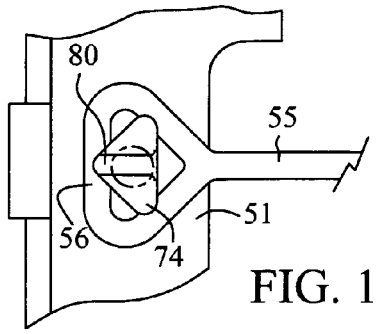
FIGS. 17 and 18 are plan views of the embodiment of FIG. 16 in closed and open conditions, respectively.
Figure 19:
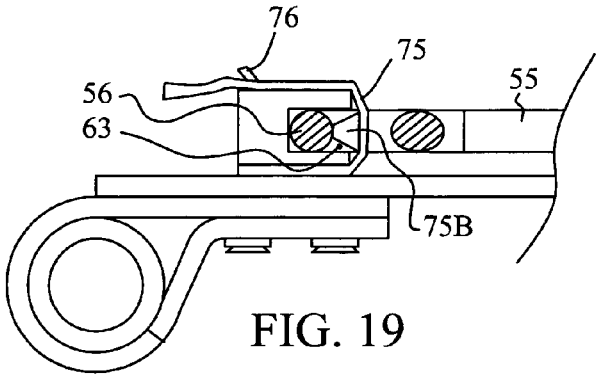
FIG. 19 is a view in elevation of an alternative embodiment utilizing a resilient strap as a retainer element.
Figure 18:
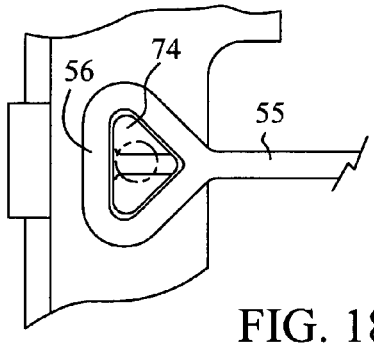
Figure 20:
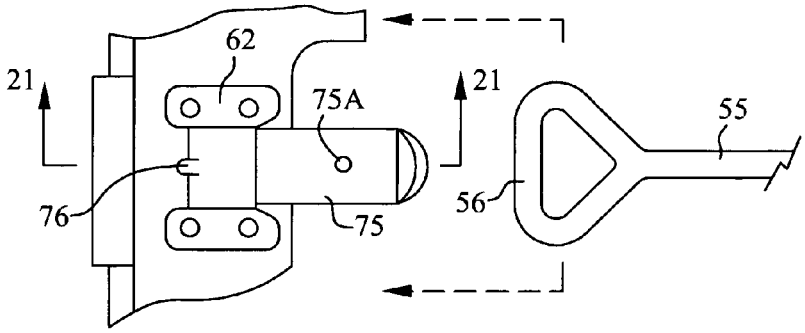
FIG. 20 is a plan view of an alternative embodiment utilizing a resilient strap as a retaining element.
Figure 21:
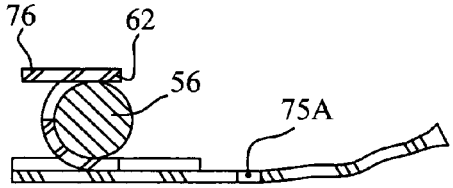
FIGS. 21 and 22 are cross sectional views of the embodiment of FIG. 20 in open and closed conditions, respectively.
Figure 22:
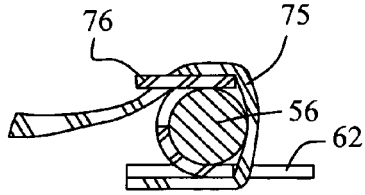

As illustrated by FIGS. 16 through 18, either or both "D" ring ends 59, 60 may be secured by a turn buckle 74 mounted to move between a release position (FIG. 18) and a capture position (FIGS. 16 and 17). It is currently preferred to rely upon a simple mount 62 (e.g. FIG. 5) at one end 60, and a turnbuckle 74 at the opposite end 59. An exemplary turnbuckle 74 may have a shaped rib or other structure forming a fingertip lever 80. Such a fingertip lever 80 functions for rotating the turnbuckle 74 and also assists as guide structure useful in locating an axle end 59, 60.

The embodiment illustrated by FIGS. 19 through 22 relies upon a resilient strap 75 to retain a longitudinal axle member 56 within the channel 63 of a mount 62. A hole 75A through the strap 75 is positioned over a post 76 to retain the axle member 56. A spacer 75B may be carried by the strap 75 to add firmness to the connection. Ideally, the spacer 75B is integral with the strap 75, and is fashioned of resilient material. The strap 75 may alternatively be of conventional fabric webbing, and the hole and post connection may be replaced with a buckle or other connector. Length adjustment of a strap 75 may be provided, for example, in association with a quick-release buckle. Among suitable buckles for this purpose are the types commonly used as the termination fixtures of recreational straps, including those currently included in certain snowshoe bindings to clamp the binding to a boot.

Figure 23:
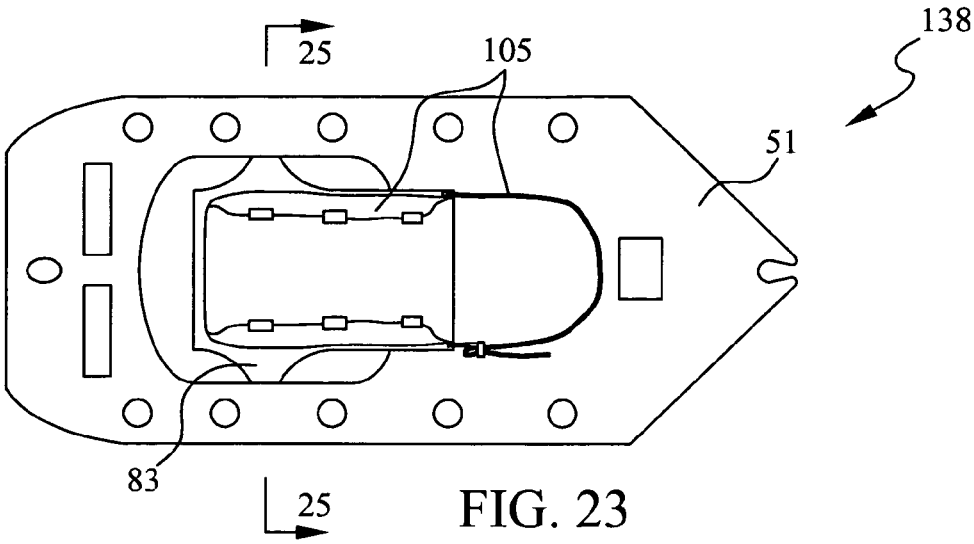
FIG. 23 PRIOR ART
FIGS. 23 through 25 are plan, side elevation and sectional views, respectively, of a snowshoe platform and binding assembly currently marketed under the trademark "MSR"
Figure 24:
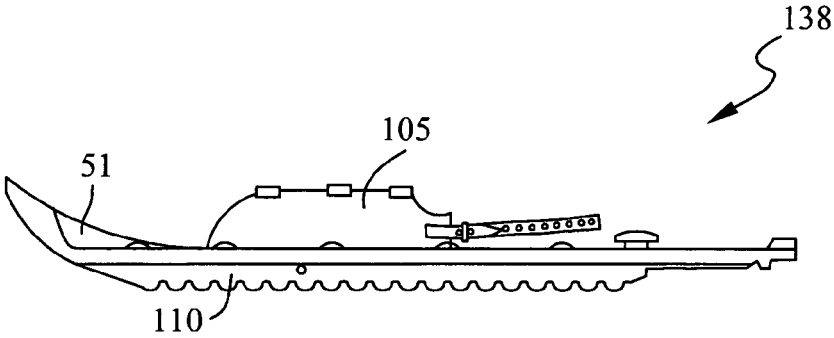
FIG. 24 PRIOR ART
Figure 25:
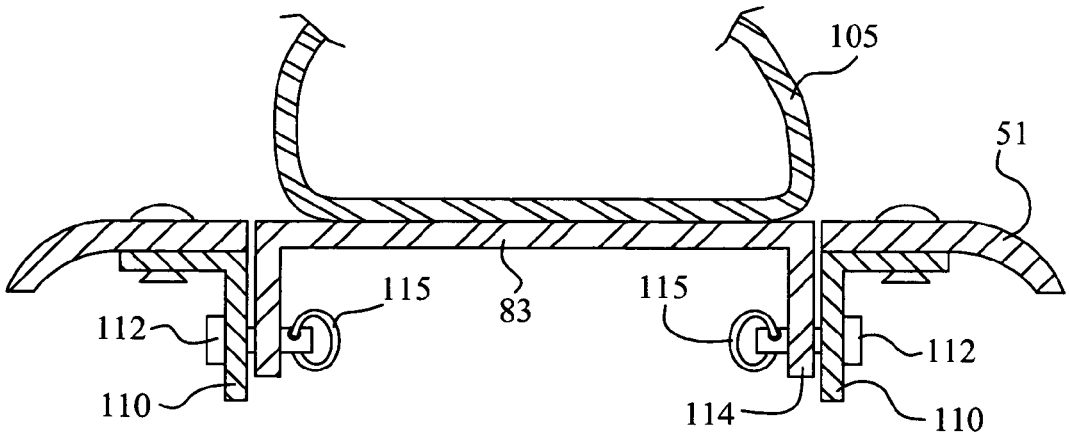
FIG. 25 PRIOR ART
Figure 26:
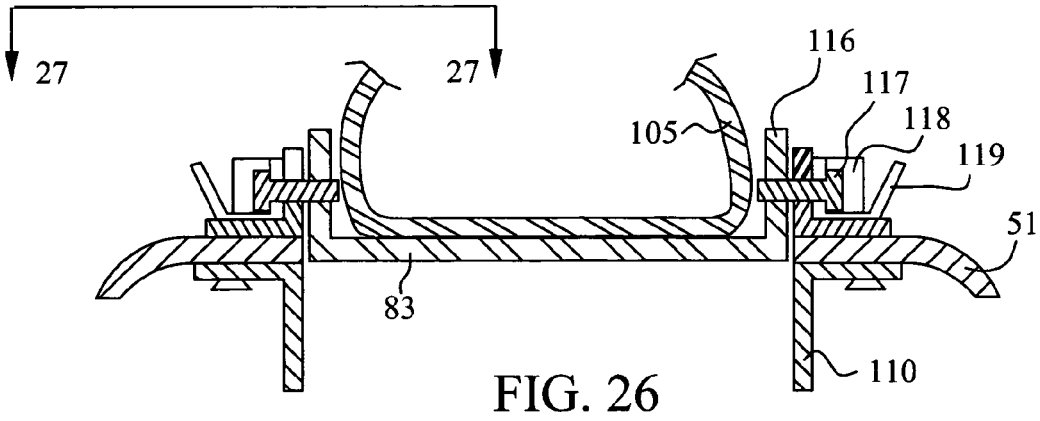
FIG. 26 is a section view in elevation of a binding base plate in captured association with a pair of biased stub axles.
Figure 27:
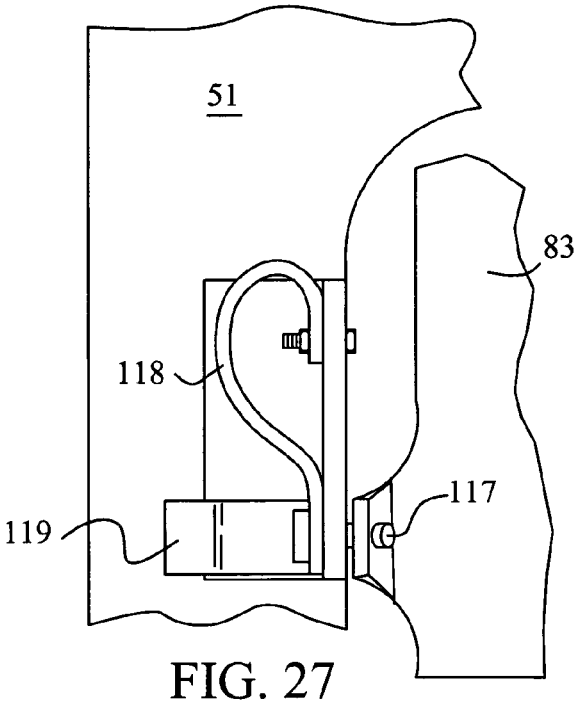
FIG. 27 is a fragmentary plan view of the embodiment of FIG. 26.
Figure 29:
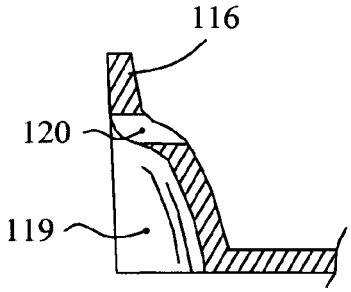
FIG. 29 is a sectional portion of the embodiment of FIG. 28 taken along section 29-29 and looking in the direction of the arrows.
Figure 28:
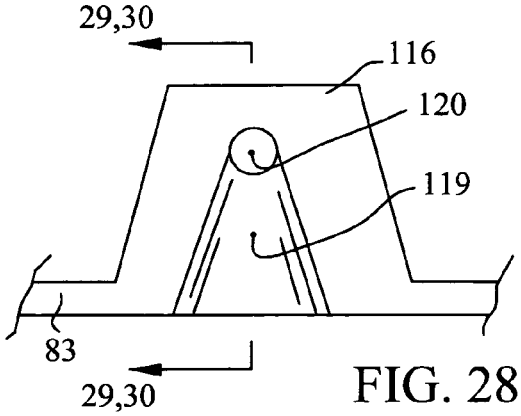
FIG. 28 illustrates a portion in elevation of a base plate having an up-leg.
Figure 30:
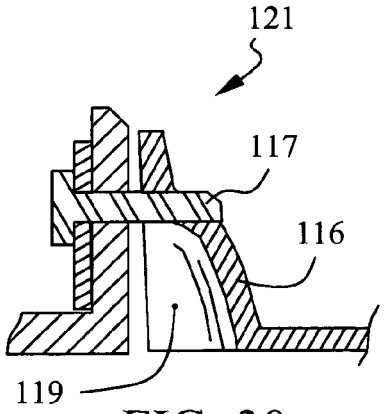
FIG. 30 is a view similar to FIG. 29, but also including a binding retainer mechanism.
Figure 31:
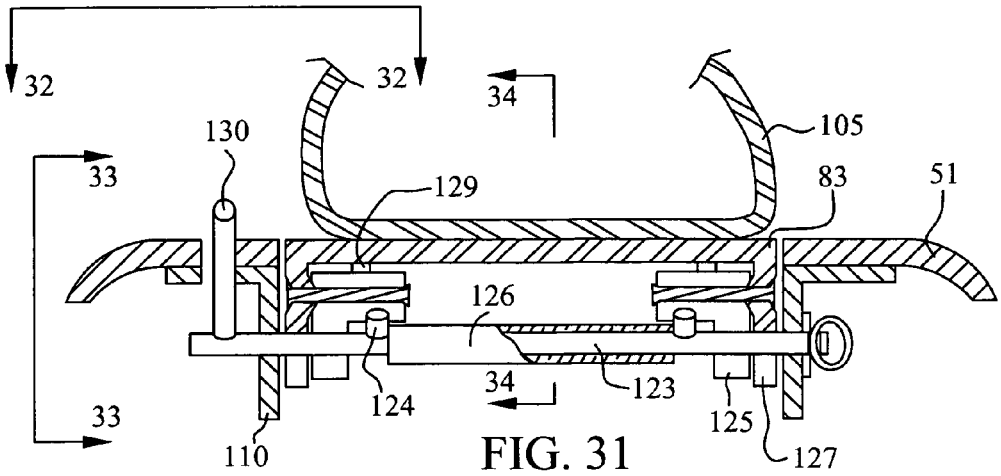
FIG. 31 is a view in elevation of a partial assembly including a binding base plate and mounting receiver in association with a fixed binding axle.

Snowshoes of the type described by the aforementioned U.S. Pat. No. 5,531,035, and currently marketed by Mountain Safety Research of Seattle, Wash. under the trademark "MSR" are especially well suited for utilization of the quick-release feature of this invention. The bindings 105 to hold a boot that are currently supplied with these snowshoes, as illustrated by FIGS. 23 through 25, require little modification to incorporate the quick-release feature. This type of binding 105 advantageously would have minimal attach structure protruding transversely from the side of a wearer's foot when released from a snowshoe deck. The chance of grazing the inside ankle area with attachment or other structure while walking is therefore minimized. Certain embodiments of the invention therefore allow a quick and easy detachment of the binding assembly from the axle or pivot arrangement. Other types or configurations of bindings 105 to hold a boot are workable. Such bindings may include simple straps, typically including some sort of buckle, or other adjustable retainer to fit to a variety of boot sizes.

In the "MSR" style of snowshoe 138, the binding base plate (or sole plate) 83, typically of metal construction, is supported from longitudinal rails 110 by shoulder axles 112. Axles 112 are assembled through the down legs 114 and secured by split rings 115. Tools are virtually required to disassemble the connection between the base plate 83 and rails 110. Subsequent to disassembly, various removed small parts are subject to loss. The difficulty of disassembly of the split rings 115 precludes field disassembly to use the crampon and boot attachment as a component or subassembly separate from the entire snowshoe assembly.

FIGS. 26 through 30 depict an alternative embodiment of a binding arrangement configured for quick-release of the crampon component from the complete snowshoe assembly. The illustrated sole plate 83 has up-legs 116 structured for engagement by stub axles 117. Stub axles 117 are biased into a latch position by spring element 118. A thumb lever 119 is structured as a convenient aide to displace the axles 117 between latch and release positions. Other structural configurations effecting coupling/decoupling movement of the axle 117 are workable.

In certain desired embodiments, a groove area 119 is structured to guide an axle 117 into engagement with a hole 120 during assembly of base 83 to a snowshoe and deck 51. An axle 117 may have a tip end 121 configured (e.g. chamfered) to facilitate a step-in engagement of the binding to snowshoe. A base plate 83 having up-legs similar to 116 provides the advantage of placing connection structure away from contact with the ground or debris while walking and wearing the crampon assembly alone. Such a configuration reduces chance of deformation or other damage to attachment mechanism structure due to weighted contact with foreign objects.

Figure 32:
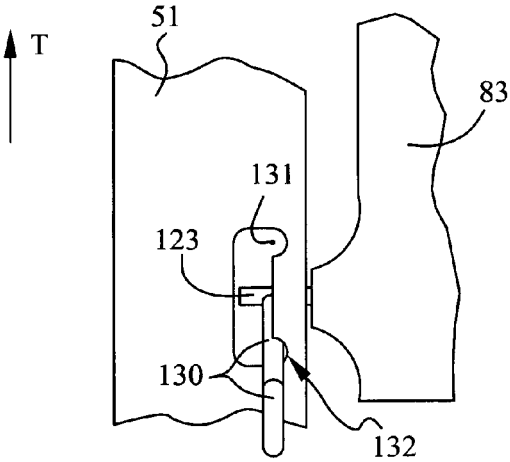
FIG. 32 is a plan view of a portion of the embodiment of FIG. 31 taken along section 32-32 and looking in the direction of the arrows.
Figure 34:
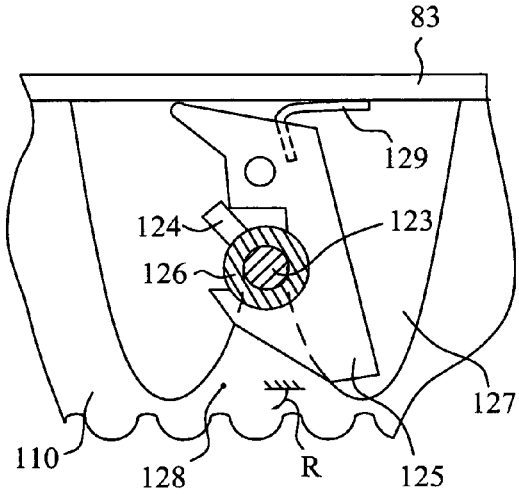
FIG. 34 illustrates details of the capture mechanism of the embodiment of FIG. 31 in a captured position.
Figure 33:
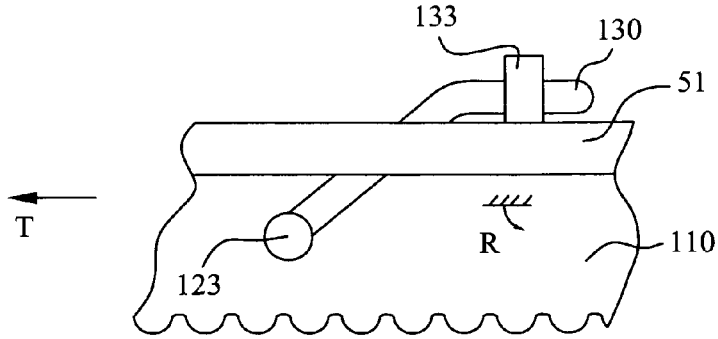
FIG. 33 is a view in elevation of an embodiment similar to FIG. 31, taken along section 33-33 and looking in the direction of the arrows.
Figure 35:
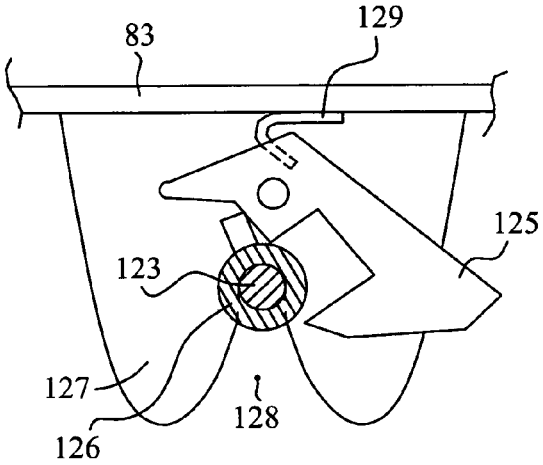
FIG. 35 is a view similar to FIG. 34 with the capture element rotated approximately 90 degrees to a release position.

FIGS. 31 through 35 illustrate an embodiment of the invention having a rotatable axle 123 carrying one or more cams 124 arranged selectively to displace one or more latch elements 125. In FIGS. 32 and 33, a toe end of the snowshoe is indicated by arrow T. Rotation of the sole plate 83 while walking is indicated by arrow R. A sleeve 126 is preferably installed on axle 123 to prevent engagement of a latch 125 in an undesired location out of registration with a cam 124. The base plate 83 has down-legs 127 with openings 128 in which are received axle 123. A latch element 125 may be biased into a latched position by a spring element 129. A step-in binding arrangement is created by cooperating axle 123 and suitably arranged latch and down-leg structure at openings 128. The binding is placed into a release position by rotating latch lever 130 to displace latch hook 125 from engagement with axle 123 due to an interference between cam 124 and hook 125 (see FIG. 34 for a latched configuration and FIG. 35 for a release position). Cam 124 displaces hook 125 as the axle 123 is rotated to a release position. Alternative structure to rotatable axle 123 and cam element 124, including tensionable cables and direct acting linkages (not shown), may be deployed selectively to displace latch elements, such as a latch 125.

The lever 130 may be maintained in either a release or retaining position by biasing the lever 130 into receipt in notches or detents 131 and 132. A bias may be created during assembly of the appropriately configured axle 123 and lever 130 into a snowshoe. An alternate configuration is illustrated in FIG. 33, where a lever 130 is retained in an engaged position by a molded-in, or otherwise formed, transverse hook element 133.

In the embodiments illustrated in FIGS. 31 through 35, portions of the latch mechanism are carried on the bottom of base plate 83 while a wearer is walking. The attachment mechanism is therefore subject to damage from walking on debris. One embodiment of a protective structure may be formed by a stamping process to create a mechanism guard rail 134, see FIG. 36. Dashed lines indicate bend locations. The thusly formed guard rail 134 and down-legs 127 also function as crampon elements to help provide secure footing while walking.

Figure 37:
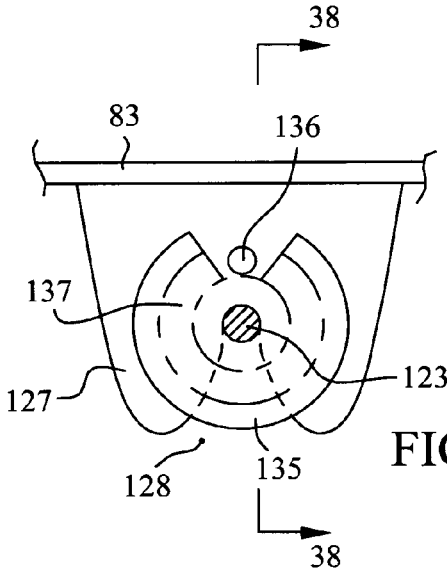
FIG. 37 is an alternative retaining mechanism for an embodiment similar to FIG. 31.
Figure 38:
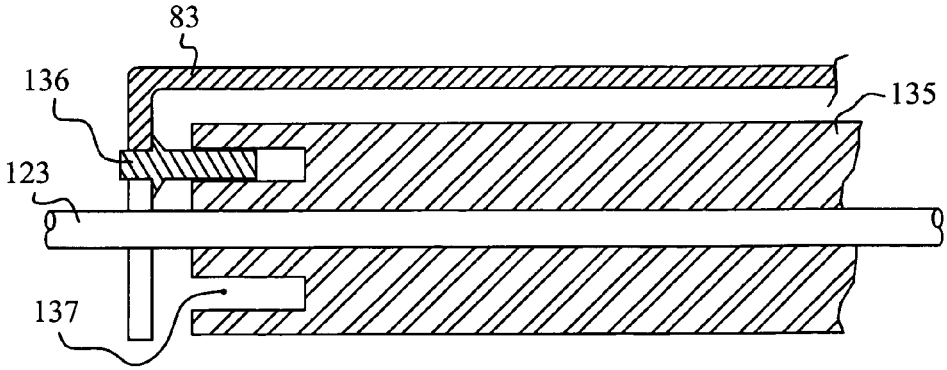
FIG. 38 is a section view of the embodiment of FIG. 37 but with the latch rotated to a capture position, taken along section 38-38 and looking in the direction of the arrows.

FIGS. 37 and 38 illustrate a more rugged variation of a quick-detach binding according to the invention. This embodiment is also capable of step-in assembly to a snowshoe flotation deck 51. The attachment mechanism uses a rotatable axle similar to FIGS. 31 through 35, but has a robust rotary latch 135 with a groove 137 in which is received a pin 136 carried by down legs 127 depending from base plate 83. A pin 136 is affixed to each of down legs 127, and combine to carry the up-load to lift a snowshoe. A design up-load should realistically accommodate lifting a snowshoe that may be stuck, e.g. under a branch, or buried under a snow load. As such, pins 136 should be capable of carrying perhaps 100 to 150 pounds each in a predominantly shear loading, depending on the fit into groove 137. The down-load generated by walking is carried by the down-leg members 127 and axle 123 and also distributed through the flotation platform onto the snow itself, similar to the loading arrangement of the known snowshoes 138 in FIGS. 23 through 25.

Figure 36:
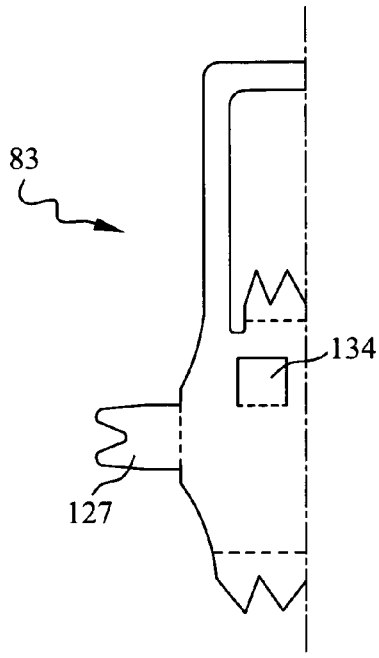
FIG. 36 illustrates a base plate bend pattern.

Latch element 135 may be a continuous member spanning substantially between left and right down legs 127. However, it is within contemplation for a pair of latch elements 135 to be disposed spaced apart on axle 123 to reduce assembly mass. The pins 136 are protected to some degree from damage, while walking in the crampon assembly alone, by their tucked away location on down legs 127. A base plate as illustrated in FIG. 36 provides additional protection for the pins 136 by incorporating additional guard rails 134. As with all embodiments of the invention, a substantial amount of dimensional tolerance between component fit in a workable assembly is desired to provide a robust and reliable binding.

Figure 39:
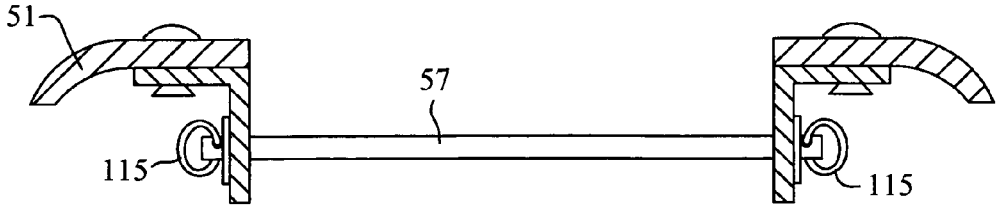
FIG. 39 is a section view in elevation of a snowshoe having a fixed transverse axle.
Figure 40:
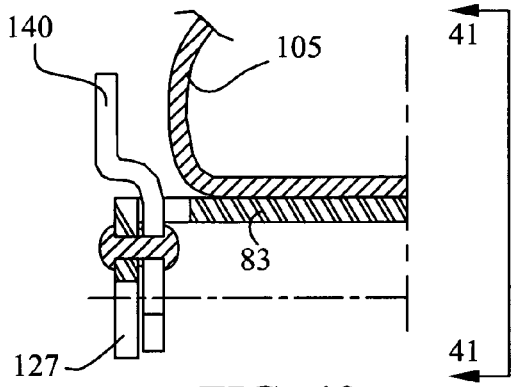
FIGS. 40 through 43 illustrate various latching mechanisms carried by the binding base plate for use with assemblies of the type illustrated by FIGS. 1 and 39.
Figure 41:
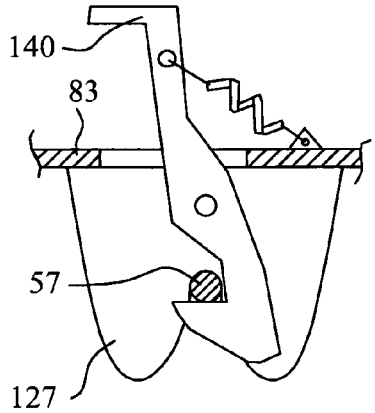

FIG. 39 illustrates a snowshoe similar to the embodiment of FIGS. 23 through 25, but modified to have a solid, fixed transverse axle 57. FIGS. 40 through 43 are various embodiments adapted to interface in releasable engagement with a snowshoe constructed according to FIG. 1 or 39. FIGS. 40 and 41 depict front and side views in cross-section of a latch mechanism having a single latch 140 disposed on each side of the base plate 83. A spring 141 may be included to bias the latch 140 into engagement with an axle 57. Alternatively, friction about the latch pivot axle, or interference between the latch 140 and other structure carried by base 83 may restrict movement of the latch 140.

Figure 42:
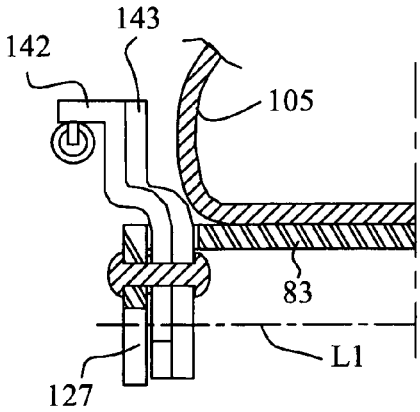
Figure 43:
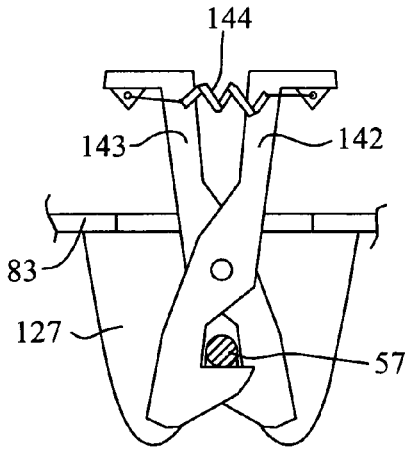

FIGS. 42 and 43 illustrate front and side views in cross-section for another embodiment having paired latch levers 142 and 143. Phantom line L1 indicated the location of an axle 57 in its installed location. Levers 142 and 143 are arranged to cooperatively engage an axle 57 with similar to a scissors action. Again, a spring 144 may bias the levers 142, 143 for automatic engagement with an axle 57. The latch levers 140, 142, and 143 may be mounted inboard, as illustrated, or outboard of the down-legs 127. It is currently preferred to configure latches 140, 142, and 143 to enable step-in engagement of a crampon subassembly with an axle 57. It is within contemplation for alternate latching arrangements, similar to the embodiments of FIGS. 40 through 43, to be anchored to a surface of a platform 51 for attachment to a removable axle, such as axle 55 in FIG. 3, or a straight axle, or paired stub axles. In such case, actuator levers may be positioned for access from above, and for actuation either by hand, or by a tool such as a ski pole tip.

Figure 44:
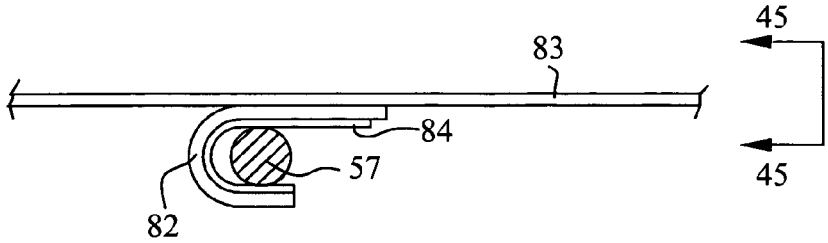
FIGS. 44 and 45 are orthogonal fragmentary views in elevation of a base plate in association with a capture channel for receiving a snowshoe axle.
Figure 45:
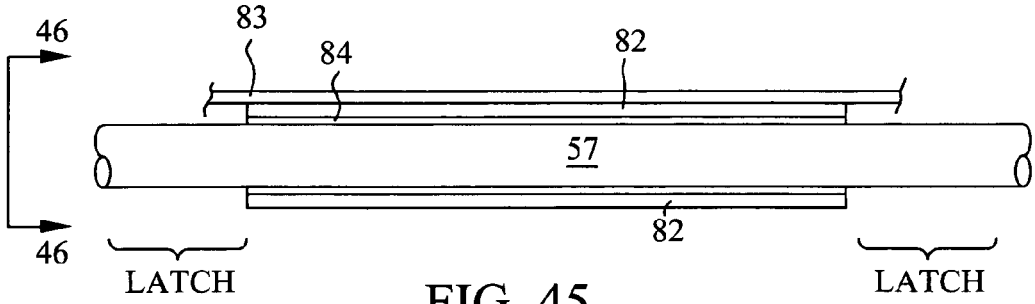

FIGS. 44 through 50 illustrate additional embodiments of the invention applied to a snowshoe with a transverse axle 57 of the type illustrated by FIGS. 1 and 39. A binding of this invention is connected to the transverse shaft 57 of the axle 55 by means of a quick-release mechanism. The axle 55 may be, or remain mounted to, the platform 51 in conventional fashion. As shown by FIGS. 44 and 45, the release mechanism includes a channel member 82 fixed to the under surface of a binding plate 83, which supports a boot (not shown) in use. Member 82 may be arranged approximately as a "U" shape. The channel member 82 may be oriented to open either to the toe or the heel of the plate 83. In either case, coupling of the plate 83 to the shaft 57 is accomplished by placing the plate 83 atop the shaft 57, and moving the plate longitudinally until the shaft is positioned within the channel as shown, for example, by FIGS. 44 and 45. The interior surface of the channel member 82 may be lined with an optional Nylon layer 84 to facilitate pivoting movement about the shaft 57. The channel member 82 is illustrated as a single element extending approximately the full width of the binding plate 83. The channel may have a length sized to maintain an attached binding assembly centered in the desired foot opening of a floatation platform 51. It is within contemplation that a substantial portion of this member could be removed, leaving spaced apart segments near the outer edges of the plate 83. In any case, various mechanical expedients are operable to retain the shaft 57 within the channel 82. Representative examples of such expedients are illustrated by FIGS. 46 through 50.

Figure 46:
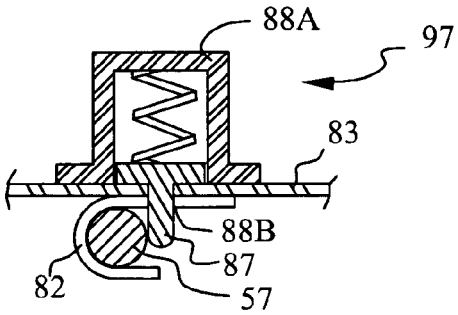
FIGS. 46 through 50 are fragmentary views of various latching mechanisms associable with the assembly of FIGS. 44 and 45.
Figure 47:
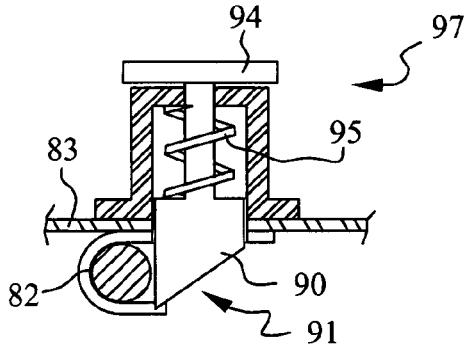

FIG. 46 shows an unlined channel member 82 coupled to a binding plate 83, and held in position by detent 87 secured within a housing 88A and bore 88B through the plate 83, as shown. These detents 87 are desirably "stiff" acting so that deliberate force is required to move the axle 57 past them to either couple or decouple the binding plate with respect to the shaft 57. An alternative arrangement is illustrated by FIG. 47. A spring-biased plunger element 90 presents a cam surface 91 forward of the channel opening 82A, such that the shaft 57 urges the tip end 92 upwardly as the shaft enters the channel 82. To decouple the plate 83 from the channel 82, it is necessary merely to lift the latch handle end 94 against the spring 95, and to slide the shaft past the plunger out of the channel. A practical positioning of release mechanisms 97 is at opposite sides of the binding plate 83.

Figure 48:
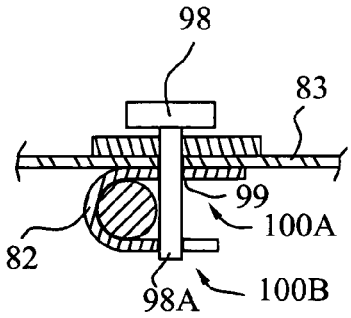
Figure 49:
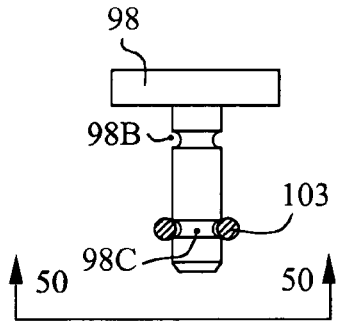
Figure 50:
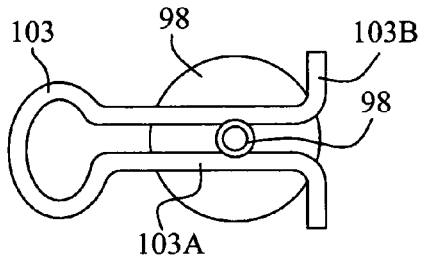

The mechanism 97 could be structured as an assembly similar to that illustrated by either of FIG. 46 or 47, as well as many other alternative mechanical arrangements providing a similar latching function. One such alternative arrangement is illustrated by FIGS. 48 through 50. A two-position push pin 98 extends through a bore 99 in an extension 100 of the binding plate 83. The extension 100 may be integral with or affixed to the plate 83. The distal end 98A of the pin 98 registers with bores 101A and 101B in the respective opposing legs of the channel 82. One way an axle may be retained, subsequent to assembly with a channel 82, is by lowering a pin 98 into the capture position as illustrated in FIG. 48. The elevation of the pin 98 can be determined by the registration of grooves 98B or 98C with the resilient legs 103A, 103B of a spring 103 mounted within either of bores 99 or 101A, as best shown by FIGS. 49 and 50.

Figure 51:
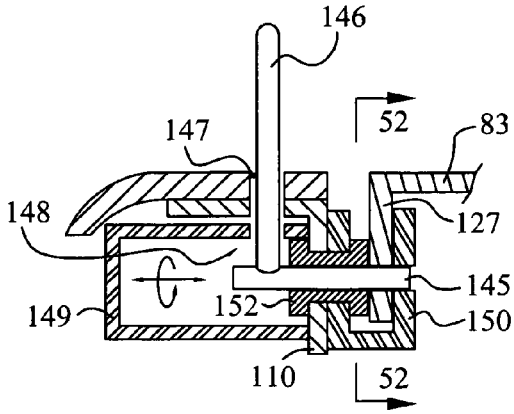
FIG. 51 is a sectional view of a attach fixture in which rotation of a latch lever displaces an axle in and out of engagement with a binding.
Figure 52:
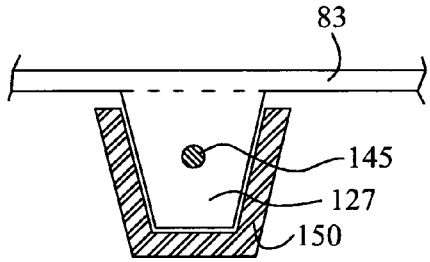
FIG. 52 is a view of the embodiment of FIG. 51, taken through section 52-52 and looking in the direction of the arrows.

A quick-release fixture using a movable stub axle 105 is illustrated by FIGS. 51 and 52. Transverse positioning of the axle 145 is effected by rotation of lever actuator 146. One or more of slots 147 and 148 may be arranged as a spiral with an effectively coarse thread pitch. Rotating lever 146 within the spiral slot therefore causes axle 145 to correspondingly translate in and out of engagement with down-leg 127. It is within contemplation for such a spiral feature alternatively to be incorporated into the axle 145 itself. The moving components may be protected within a housing 149. Slot 148 may be located in the top of housing 149, if such a top is present. A spiral slot may further have structure, such as detents (not shown) to receive lever 146, arranged to resist undesired rotational displacement of the lever 146. Lever 146 may also, or alternatively, be biased by a spring element (also not shown). Down-leg 127 is received in guide cup 150 to facilitate connection of a base plate 83 to a floatation platform. Guide cup 150 is pivotally attached to rail 110 by hollow barrel 152.

Figure 53:
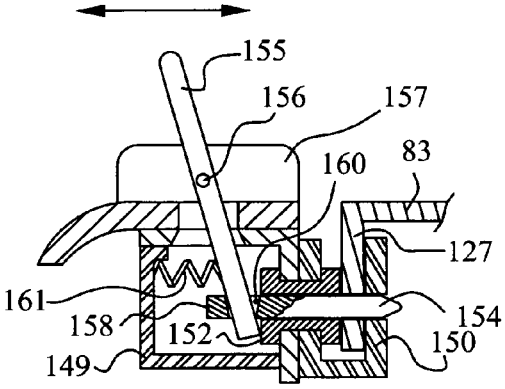
FIG. 53 illustrates an alternate embodiment, similar to FIG. 51, but with a pivoting latch lever.

An alternative arrangement for displacing a stub axle 154 is illustrated in FIG. 53. Actuator lever 155 is pivotally attached at 156 to pivot structure 157. Stub axle 154 is shown partially in section to illustrate structural details of construction. Distal end 158 is received in slot 160 to induce transverse motion in axle 154 commensurate with displacement of lever 155. Axle 154 may be biased into a binding attached position by a spring 161. Again, moving components may be protected by housing 149 from damage incurred by walking on debris.

Figure 54:
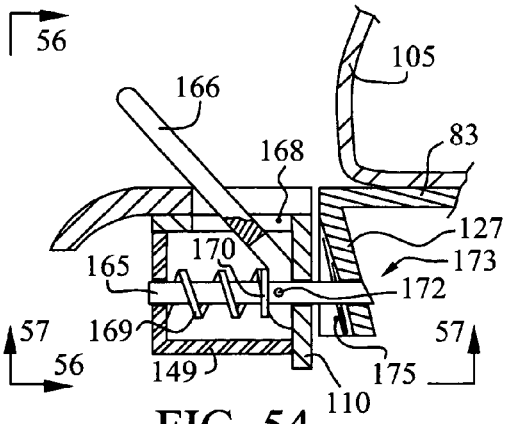
FIG. 54 is a view similar to FIG. 51 of a currently preferred embodiment with a pivoting latch lever in a binding attached position.

A currently preferred quick-attach fixture having a transversely actuated stub axle 165 is illustrated in FIGS. 54 through 57. Finger actuated lever 166 in FIG. 54 is shown partially in cross-section to illustrate a typical pinned clevice connection arrangement with axle 165. Axle 165 is received in hole 167 in down-leg 127 to maintain a sole plate 83 of a footwear binding in pivoting relation with a snowshoe floatation platform 50. A slot 168 through rail 110 and deck 51 allows rotation of the free end of lever 166.

Figure 55:
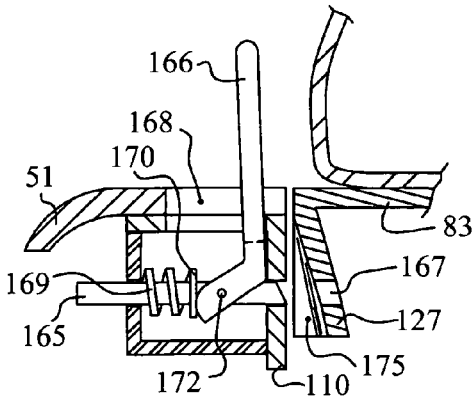
FIG. 55 illustrates the embodiment of FIG. 54 in a binding release position.
Figure 56:
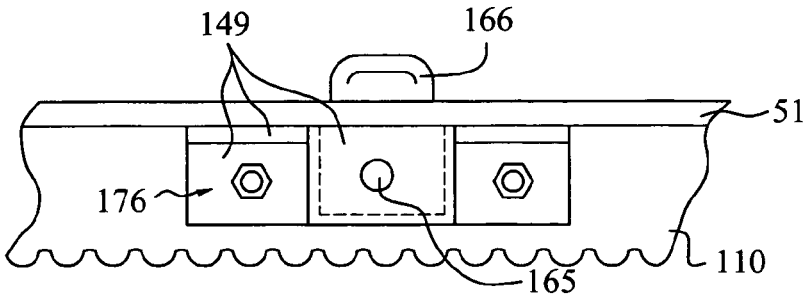
FIG. 56 is a fragmentary side view of the embodiment of FIG. 54, taken through section 56-56 and looking in the direction of the arrows.
Figure 57:
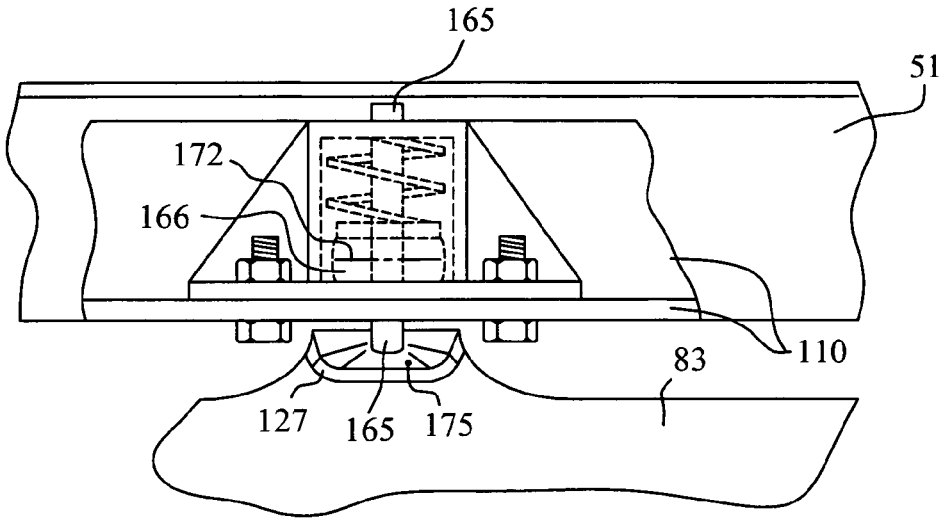
FIG. 57 is a fragmentary bottom view of the embodiment of FIG. 54, taken through section 57-57 and looking in the direction of the arrows.

With reference to FIGS. 54 and 55, a lever 166 can be biased to an attach position with a spring 169 and washer 170. Lever 166 is pivotally attached to axle 165 at axle 172. The illustrated dog leg shape of lever 166 therefore inherently returns to an attach position under the influence of spring 169. Attach fixture structure such as lever 166 may also be arranged to maintain the fixture in a release position, if desired. Certain embodiments may be constructed to maintain an attach fixture optionally between an open position, or biased to a closed position. Of note also, in FIG. 57, the housing 149 may be sized to help retain axle 172 through axle 165 and in engagement with lever 166. The interior width of the housing may be sized to prevent a pivot axle 172 from sliding out of engagement between the stub axle 165 and lever 166.

Distal end 173 of axle 165 and down-leg 127 may be cooperatively structured to provide a step-in assembly capability. Similar to cone 119 in FIGS. 28 through 30, a relief shape 175 may be formed into down-leg 127. Such a tapered relief shape 175 serves to transversely depress the stub axle 165 during step-in assembly of the binding plate 83 to a flotation platform. Relief shape 175 also helps guide end 173 into engagement with hole 167 as down-leg 127 is lowered into position. Additionally, transversely arranging portions of down-leg 127 with structure similar to that forming shape 175 increases the down-leg's stiffness and resistance to damage from stepping on debris.

Step-in assembly of the snowshoe assembly typically means the wearer places the binding in close proximity to the platform and in any alignment required by mutually connecting elements. The wearer then moves the binding a short distance (typically stepping downwardly) to effect engagement of connecting structure simply by the displacement of the binding. In certain embodiments of the invention, step-in assembly also encompasses placing the binding substantially in position on a platform, and actuating a simple mechanism to make the attachment there between. Exemplary such mechanisms include various latches, buckles, toggle elements, and quick-engaging straps.

A housing 149 serves to protect moving components from damage. Housing 149 also provides a first bearing surface for an end of axle 165. A second bearing surface for axle 165 is provided by rail 110. These bearing surfaces are spaced apart, providing a torque to stabilize axle 165. Housing 149 may be made from metal or other structural material, including various tough plastics.

As illustrated, housing 149 may be attached to a rail 110 with one or more readily available fasteners 176. By careful placement of the fasteners 176 and shaping down-legs 127, a stop to prevent over-rotation of a baseplate 83 and deck 51 may be accomplished by creating an interference between down-leg 127 and a fastener 176 subsequent to sufficient rotation between the platform and the interfering portion of the base plate. This arrangement can be advantageous when walking in deep snow or stepping over an obstacle. A tail-heavy snowshoe can rotate to point tail-down when lifted clear of the snow. If stood on in such a configuration, the platform will simply plunge lengthwise into the snow, like a shovel blade. One or more rotation limiting stops to prevent such over-rotation enable the platform to be placed onto the snow surface in an orientation to effectively load its bottom surface. Of course, the baseplate must be allowed to rotate sufficiently to accommodate walking without annoyingly lifting the shoe tail at every stride.

The illustrated housing 149 in FIGS. 54 and 55 has a bottom surface located opposite from slot 168. Such a bottom surface is not required and may be eliminated. One benefit from removing the bottom is that snow and ice may be easily scraped or otherwise removed from the internal moving parts. Any water accumulating in the mechanism area will also drain better, reducing potential freezing problems.

Figure 58:
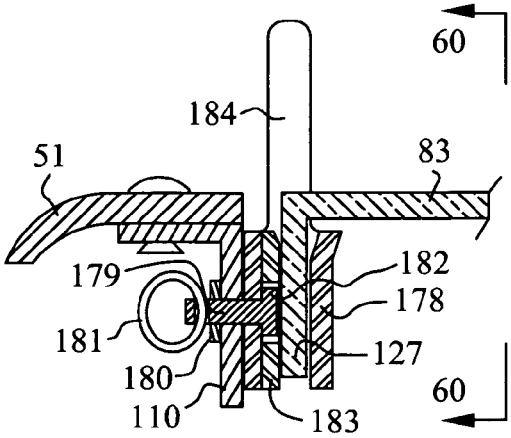
FIG. 58 is a view similar to FIG. 51 of an alternate embodiment.

The attachment fixture embodiment illustrated in FIG. 58 receives down-leg 127 in engagement within a socket 178. Socket 178 is rotatably attached to rail 110, as by pin 179, washer 180, and split ring 181. Wall structure of socket 178 may be countersunk to receive the head 182 of pin 179, or a spacer 183 may be installed to prevent interference between head 182 and down-leg 127 during connection of the assembly. Guide lever 184 aides in aligning down-legs into position for reception in socket 178. Socket 178 may be structured, with chamfers and/or enlarged openings as illustrated, further to promote entry of a down-leg 127 into the socket 178.

Figure 59:
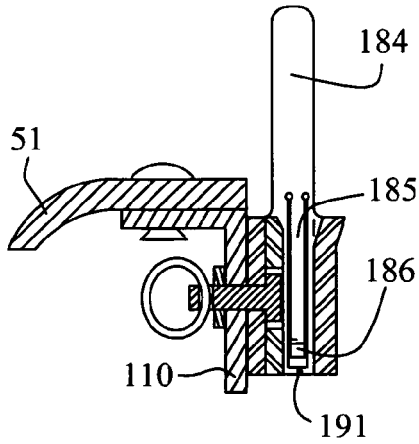
FIG. 59 illustrates the embodiment of FIG. 58 with the base plate and down-leg removed.
Figure 60:
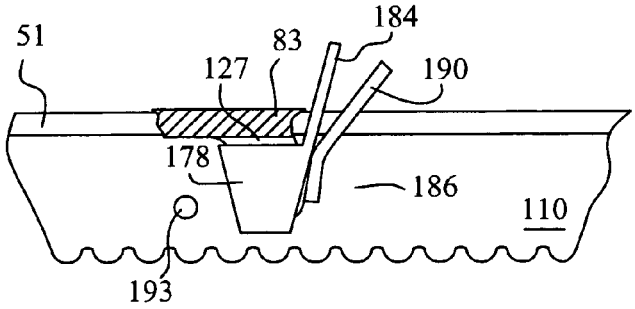
FIG. 60 is a side view of the embodiment of FIG. 58, taken through section 60-60, and looking in the direction of the arrows.
Figure 61:
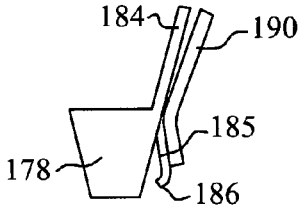
FIG. 61 illustrates a capture socket of the embodiment of FIG. 58 in a release position.
Figure 62:
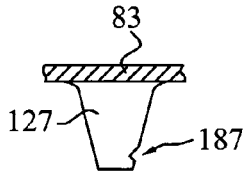
FIG. 62 illustrates a down-leg configured for use with the socket of FIG. 61.

With reference to FIGS. 59 through 61, a retaining element to capture leg 127 in an attached position within a socket 178 may be a self-biased latch 185. Latch 185 has a latch hook end 186 structured cooperatively to interface with notch 187 in leg 127 (FIG. 62). Latch 185 is attached to actuator lever 190, operable to decouple the assembly. Socket 178 is preferably made with an open bottom 191 (FIG. 59). An open bottomed socket 178 is self-cleaning, in that insertion of a down-leg 127 into socket 178 drives out any snow or ice present in the socket. FIG. 60 illustrates a rotation stop 193 positioned for interference with socket 178 subsequent to sufficient rotation of a base plate 83 and down-leg 127.

It is within contemplation for a snow boot directly to include structure of a quick-release binding according to this invention. A snowboarder may desire to use one pair of snow boots adapted to quick-connect both to his snowshoes/walking crampons, and to his snowboard. In one example, a support block is mounted to the boot sole surface such that posts extend inwardly and outwardly, respectively. These posts engage inner and outer receptacles as previously described. The boot sole may further be provided with optional crampon structures. A sole cap may connect to the boot in position to cover the crampon structures when it is desired to walk across hard surfaces which might be damaged by or be damaging to these crampon structures. An intermediate crampon plate may alternatively quick-connect between the boot and snowshoe. The crampon may then be used as desired with the boot alone, or in combination with a snowshoe. An alternative boot embodiment can have a recessed channel in the boot sole constructed to couple with an axle of a snowshoe. A release may be accomplished by actuator structure as discussed above, including levers and application of tension to one or more cables. It is within contemplation to adapt snowboard bindings to an intermediate crampon plate for use separately or in combination with a snowshoe platform. An embodiment simply serving to quick-connect a snow boot to a snowshoe lacking a removable intermediate crampon is also within contemplation.

It is further within contemplation to form a binding attach mechanism sole plate 83 having rigid upstanding ears, typically of metal construction, carrying short axle projections. These axles are insertable into channels of fixtures mounted atop the flotation platform. The axles are typically captured within the channels by a pivoting toggle member or other capture mechanism. While the toggle may be biased toward or latched into its closed position, such precautions are not ordinarily required because of the preferred location of the pivot axis of the toggle. The channel restrains movement of the axle in all directions except in the direction of the channel opening. Movement in that direction urges the toggle to pivot closed. Release of the axles from the fixtures is accomplished by rotating the toggles to their open position.

Figure 63:
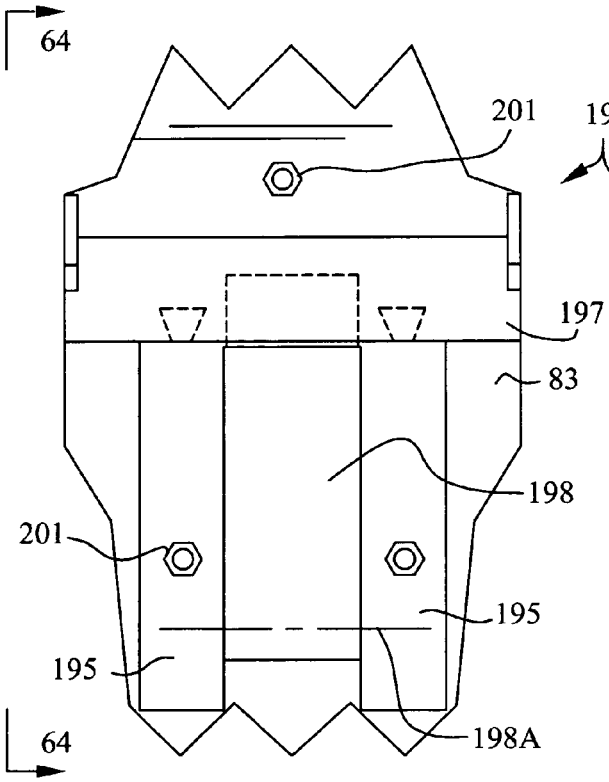
FIG. 63 is a bottom view of a crampon portion of an embodiment adapted to couple to a fixed-axle snowshoe platform.
Figure 64:
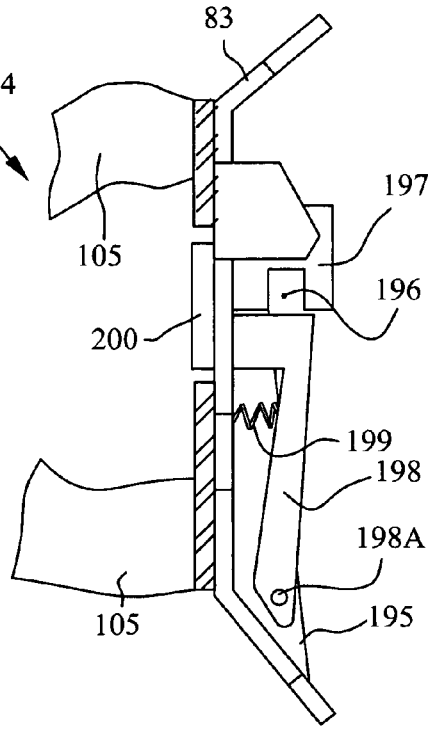
FIG. 64. is a side view, partially in section, of the embodiment illustrated in FIG. 63, with the near side axle guide component removed for clarity.

FIGS. 63 and 64 illustrate certain details of an embodiment of a removable binding, generally indicated at 194 and carrying a crampon, adapted to interface with a fixed axle 55 or 57 (see FIGS. 1 and 39). Guide rails 195 assist in placing an axle into engagement with a channel 196 carried in cross member 197. A release trigger 198, rotatably mounted to pivot axle 198A, may be biased into an axle capture position by a spring 199. Dogleg portion 200 of illustrated trigger 198 passes through crampon base plate 83 and prevents inadvertent actuation of trigger 198 due to stepping on debris. Footwear, or the sole of a boot, interferes with displacement of the trigger 198 from a retaining position. In an alternate embodiment, dogleg 200 may be absent to facilitate step-in assembly of a binding assembly to a flotation platform. In such case, a protruding lip may be formed in a member of channel 196 to provide a rotation stop for trigger 198. Fasteners 201 may connect a boot binding strap system 105 to the baseplate 83.

Figure 66:
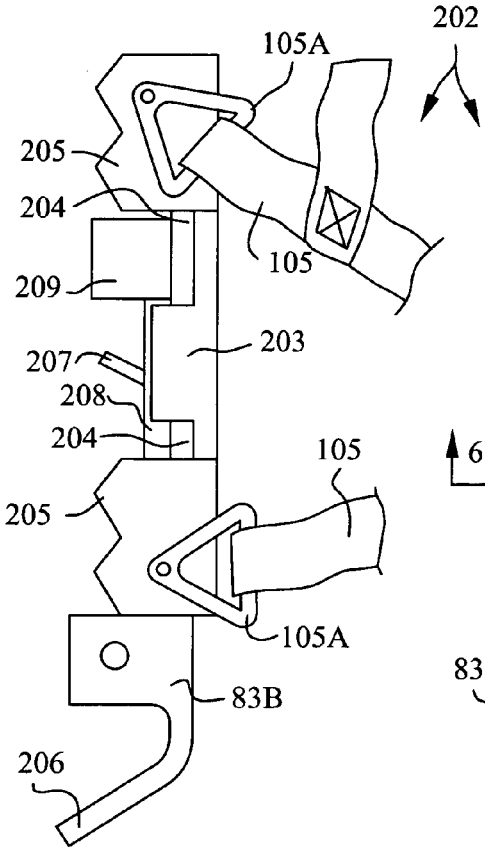
FIG. 66 is a side view of the crampon portion and including binding straps of the embodiment illustrated in FIG. 65.
Figure 65:
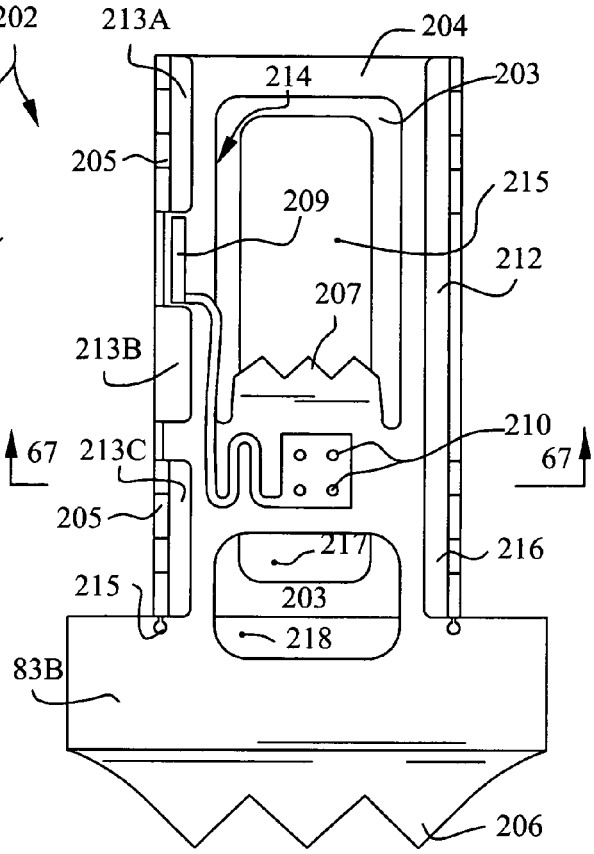
FIG. 65 is a bottom view of a slide-on walking crampon embodiment assembled onto a snowshoe crampon tang.
Figure 67:
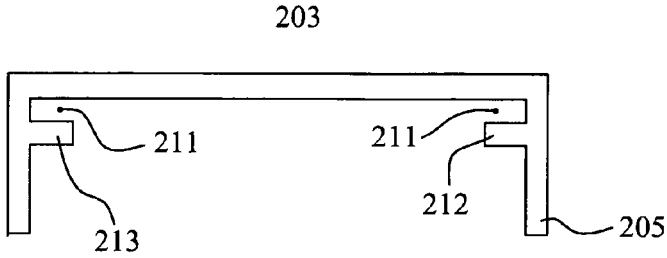
FIG. 67 is a cross-section view of the embodiment illustrated in FIG. 65, taken through the section 67-67, and looking in the direction of the arrows.

It is recognized that a snowshoe crampon is not necessarily optimized for use separately as a walking crampon. The presence of a large and projecting front crampon point, while beneficial for uphill traction when snowshoeing, can be inconvenient for prolonged periods of walking on more level terrain. FIGS. 65, 66, and 67 illustrate details of an embodiment, generally 202, of the invention adapted as an optimized walking crampon 203, structured to interface with a tang structure 204 of an optimized snowshoe. As illustrated, tang structure 204 may be embodied as a rearwardly projecting portion of a snowshoe crampon base plate, such as a modified base plate 83B. A tang may also be a projecting portion of structure rotatably attached to a snowshoe deck 51. Such alternate tang structure is not required to possess the traction points of a snowshoe crampon. The illustrated base plate 83B in FIG. 65 is similar to the base plate used on the MSR snowshoe illustrated in FIGS. 23 and 24.

As illustrated in FIG. 66, walking crampon 203 carries boot binding structure 105 to hold the crampon 203 to a hiker's boot. Such binding structure 105 may be attached in many ways to a crampon 203, one of which is illustrated as swivel structure 105A. The crampon 203 carries traction teeth 205 which may supplement forward and rear teeth, 206 and 207 respectively, of base 83B when assembled to a snowshoe.

One configuration to attach the crampon 203 to a base plate 83B is illustrated as spring lever 208 and actuator and latch structure 209. Spring lever 208 may be attached to base plate 83B by mechanical fasteners, including screws, rivets, and bolts, or by welding, or spot welding as indicated at 210. Tang 204 is received in a pair of oppositely disposed channels 211 formed by overlaps 212 and 213 (FIG. 67). Overlap 212 is illustrated as a continuous member from front to rear of crampon 203. An overlap may also be intermittent, as illustrated by 213A-C.

It is currently preferred to manufacture a crampon 203 as sections cut from an extrusion of a suitable material. Aluminum and other metals are material suitable for such manufacturing technique. It is further within contemplation to injection mold or extrude the crampon 203 from a plastic material, and reinforce the traction teeth 205 with a suitable material for increased resistance to abrasion. Teeth 205 may be arranged intermittently, as illustrated, or may span the full length, from front to back, of the crampon 203.

It is convenient to facilitate removal of the crampon from a snowshoe, while wearing the crampon portion 203 on a boot, to be able to toggle the latch 208 into an open position. With the latch toggled open, a snowshoer can stand up and ergonomically slide the crampon out of engagement with the snowshoe. Such a desired latching mechanism can easily be accomplished, in the illustrated embodiment of FIG. 65, by simultaneously pressing laterally and vertically (toward a boot sole) on actuator structure 209 to move the latch 208 out of engagement with rail portion 211B. Actuator latch structure 209 will then drop into engagement with edge 214 of weight reduction cutout 215 of base plate 83B, and the crampon 203 will then be released for hands-free sliding disengagement from tang 204.

The latch mechanism may be "re-armed" for engagement with a crampon 203, by structure (not illustrated), carried by the crampon 203 and arranged to nudge lever 208 out of engagement with edge 214 as the crampon 203 is retracted from engagement with base plate 83B. Such re-arming structure may essentially be formed as a lever biased to a position for nudging lever 208 out of engagement with edge 214, and capable of displacing to permit assembly and disassembly of a tang 204 and a crampon 203. The lever 208 may also be "re-armed", or released from the toggled open position, by hand subsequent to separation of the crampon 203 and base plate 83B. A crampon 203 may be attached to a snowshoe by tool-free engagement of tang 204 and crampon 203 while wearing the crampon 203 on a boot, substantially as a step-in, quick-connect operation. Other toggling latch mechanisms are also within contemplation to afford such quick-connect or quick-disconnect convenience. Preferred latching or retaining mechanisms will have their constituent components carried in attached combination between the binding 202 and a snowshoe. In other words, no bolts, pins, or axles are removed from the components of the assembly to effect the quick-connecting or decoupling operations. The constituent structures (e.g. male and female portions) of a latch assembly are desirably carried in combination by the two structures being connected.

The coupling arrangement illustrated in FIGS. 65 and 66 effectively protects the retention mechanism 208 by the flotation platform of the snowshoe. Latch 208 sits on top of the flotation platform, which is an effective barricade to debris on which a snowshoer may step. The walking crampon 203, when released from the base plate 83B, therefore carries no delicate mechanism which can be damaged while stepping on rocks or other debris.

With reference to FIG. 65, a stress reducing cutout 215 may be provided in a base plate 83B to reduce bending stress applied from a crampon 203 while walking. Such a configuration permits base plate 83B to form a positive stop for forward end 216 of overlap 212. Also, or alternatively, forward end 216 may be structured to overlap base plate 83B additionally in a forward direction. Weight reducing holes, such as hole 217 (visible through holes 215 and 218 in base plate 83B) may be placed in the crampon 203 to lighten the load carried by a snowshoer.

Other configurations of alternative structures adapted to couple a crampon 203 to a tang 204 are within contemplation. Nonlimiting examples include providing structural changes to a crampon to eliminate the channels 211. In such case, a capture lip of a crampon 203 may interface with an edge portion of hole 218 to secure a forward portion of the crampon 203 to plate 83B. A rotating latch mechanism, or a step-in actuated mechanism, may be provided to secure a rear portion of the crampon 203 to plate 83B. In any case, it is generally desired to provide a crampon 203 that is at least substantially free from mechanisms which may be damaged by stepping upon debris or rocks when used independently from a platform 51. Furthermore, a reduction in complexity of mechanisms is desired. Additionally, it is desired to reduce areas, such as channels 211, where ice may form and inhibit smooth operation of the connection and disconnection mechanisms.

A modified mountaineering or hiking crampon may serve as an exemplary binding and base plate. Such a crampon may be attached to a boot with conventional straps or with a modern binding having a toe bail and heel toggle buckle. A pivot axle may serve as the quick-connect fixture. The pivot axle may be fashioned substantially as a large safety pin. The "pin" shaft may be fed though tubular structure welded to, or formed in, the bottom surface of the crampon, and received on opposite sides of the foot in holes through brackets attached to the platform. The free end of the "pin" shaft may be secured by a U-shaped clip, or other suitable retaining structure. Certain types of plate-soled crampons may alternatively have one or more through-holes in the plate element through which the "pin" axle may be threaded. Other quick-connect structure may also be used between a crampon and snowshoe platform.

The invention generally provides a snowshoe that is adjustable in the field to accommodate changes in snow conditions and terrain. One aspect of the present invention encompasses connecting a binding to a snowshoe with a quick-connect fixture. In general, a binding detachably receives footwear, and typically provides a crampon-like traction assisting structure. It is within contemplation that a binding may be built-in to certain footwear. The quick-connect fixture according to this invention may have a first part or assembly attached somehow to some structure associated with a snowshoe flotation platform, and a second part or assembly carried in some way by the binding. The first and second parts cooperate to detachably couple the binding to the snowshoe. The quick-connect fixture desirably is operable to attach (or detach) the binding to the snowshoe without removing the binding from the footwear of a user. Step-in connectivity between the binding and snowshoe platform is preferred. A desirable quick-connect fixture further is operable without requiring the use of tools. Certain alternative embodiments may be facilitated in operation by the employment of a tool such as the tip of a ski pole. A quick-connect assembly may include any combination of active and passive fixtures.

A second aspect of the invention encompasses adjusting the size of a snowshoe's flotation platform to accommodate changes in snow conditions and terrain. A length adjustable snowshoe assembly, generally 220, illustrated by FIGS. 68 and 69, includes a binding segment 222, which typically includes a binding axle 224 upon which a binding (not shown) may be pivotally mounted. A binding is generally provided to allow a wearer's toe to pivot for engagement with the snow through opening 225. A binding may be installed as either a permanently or releasably mounted component. In either case, the binding segment 222 may carry various depending structures (not shown) to improve traction and stability. Although the binding segment can be worn as a small snowshoe, it is ordinarily assembled with a nose segment 226 and a tail segment 228 to create a small snowshoe assembly. Of course, the binding segment 222 may be integral with a nose segment 226 in certain embodiments.

Figure 68:
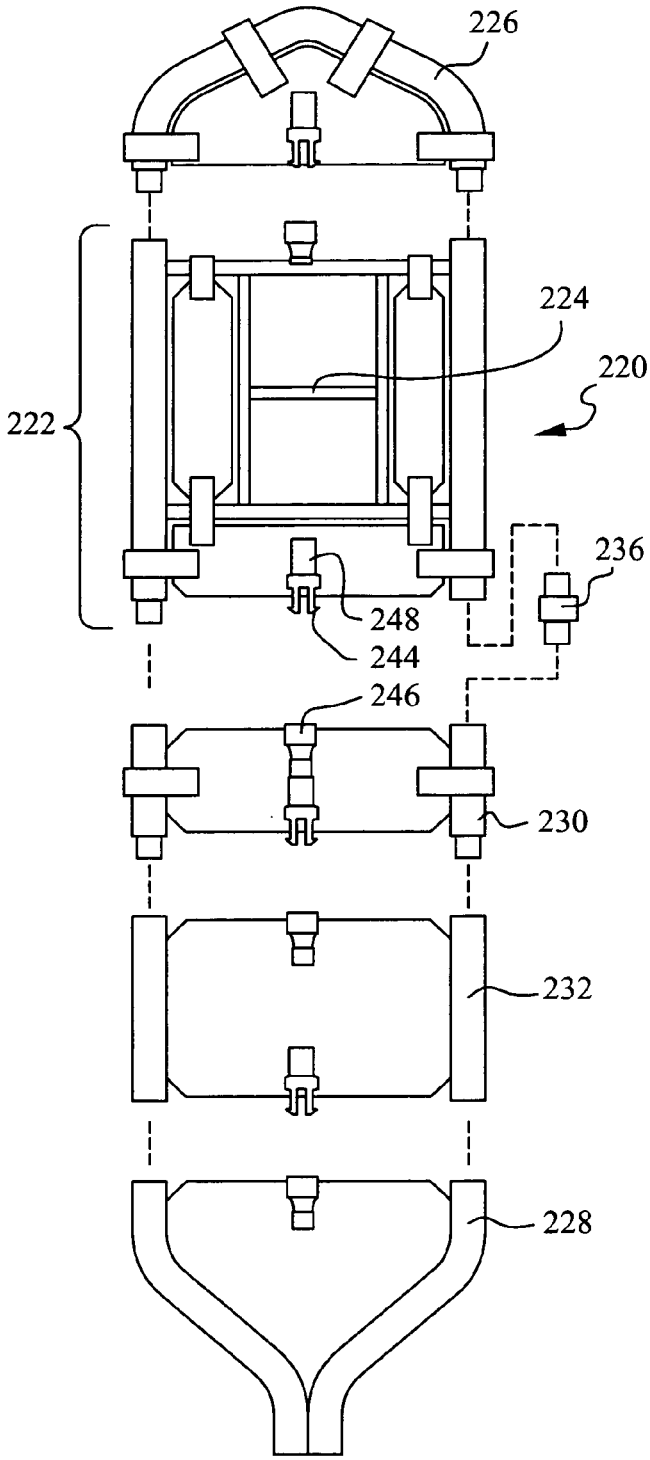
FIG. 68 is an exploded plan view of a length adjustable snowshoe of this invention.
Figure 70:
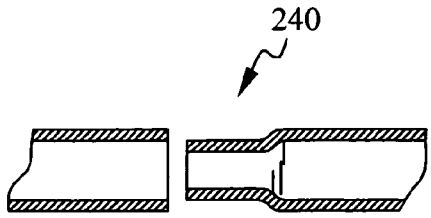
FIG. 70 is a sectional view in elevation of a portion of an alternative connector/joint suitable for use in this invention.

Joints between segments may include plug-fit sections, as illustrated in FIGS. 68 and 70. An optional adapter 236 may be placed between segments. As an alternative, a joint 240 may be formed by a reduction in diameter of one side of the joint to fit internal to the other side. Segments may be maintained in assembled position by fasteners, such as quick-connect buckles 242. A typical connector 242 has a male end 244 which plugs into female portion 246. A strap 248 may be included to provide a tension adjustment.

Figure 69:
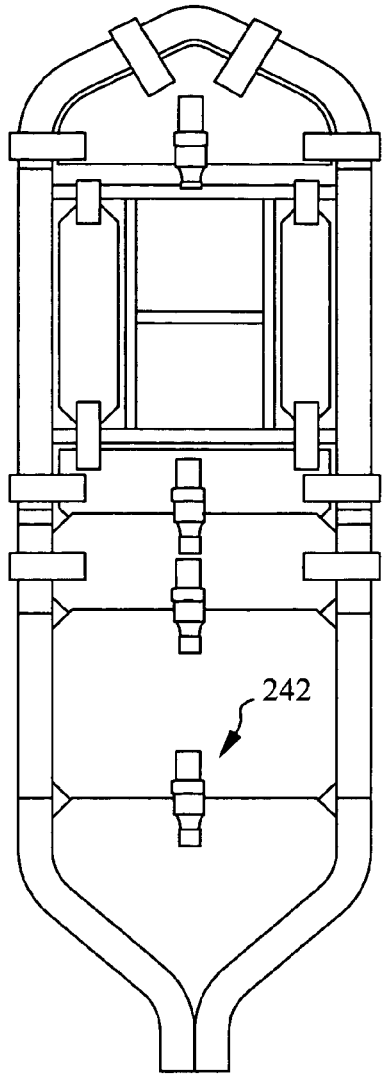
FIG. 69 is an assembled plan view of the embodiment of FIG. 68.

As illustrated in FIGS. 68 and 69, intermediate segments 230 and 232 may be located between the binding segment 222 and either or both of the nose and tail segments 226 and 228, respectively. It may be desired to form a snowshoe having a longer segment located behind the foot (as illustrated in FIG. 69), for use in ascending a steep trail in deep and unconsolidated snow. A longer front section, formed by placing one or more intermediate segments 230 or 232, forward of segment 222, may be useful for descending steep terrain. On flat terrain in unconsolidated snow, it may be beneficial to locate a segment 230 forward of segment 222, and a segment such as 232 between segment 222 and segment 228 to form a more balanced snowshoe. While the footprint of the assembled shoe may be selected to fit the preferences of an individual, a typical smallest footprint for the illustrated assembly 220 will be about 8 inches wide by about 16 inches long.

Figure 71:
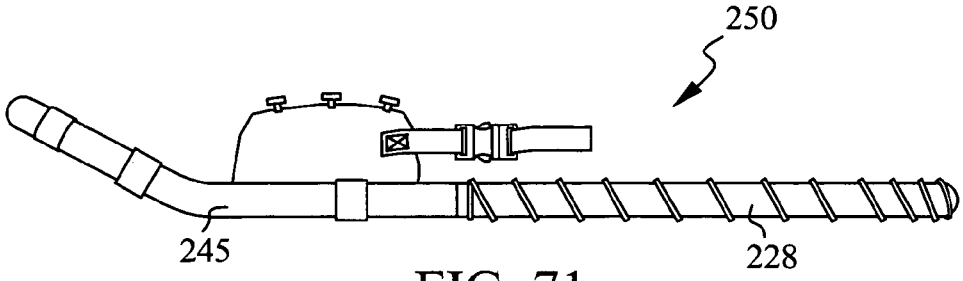
FIG. 71 is a side view in elevation of an alternative embodiment of this invention being assembled with two sections.
Figure 72:
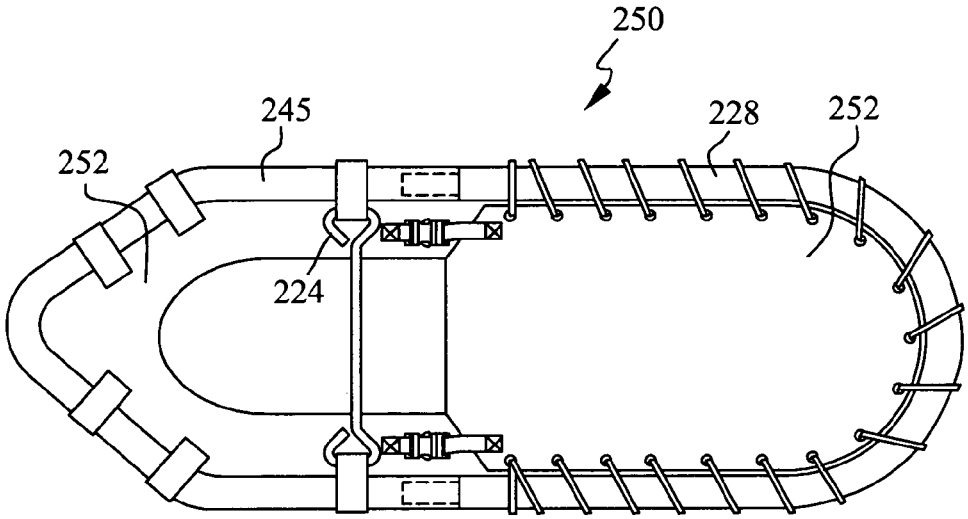
FIG. 72 is a plan view of the embodiment of FIG. 71 with the binding removed.

FIGS. 71 and 72 illustrate a second alternative and compact embodiment of the invention, generally indicated at 250, having an integral nose and binding segment 245, and a tail segment 228. One or more intermediate segments 230, not illustrated, may be inserted between segments 245 and 228 to increase the length of the snowshoe 250. Alternative methods of attaching flotation platforms 252 are also illustrated.

Figure 73:
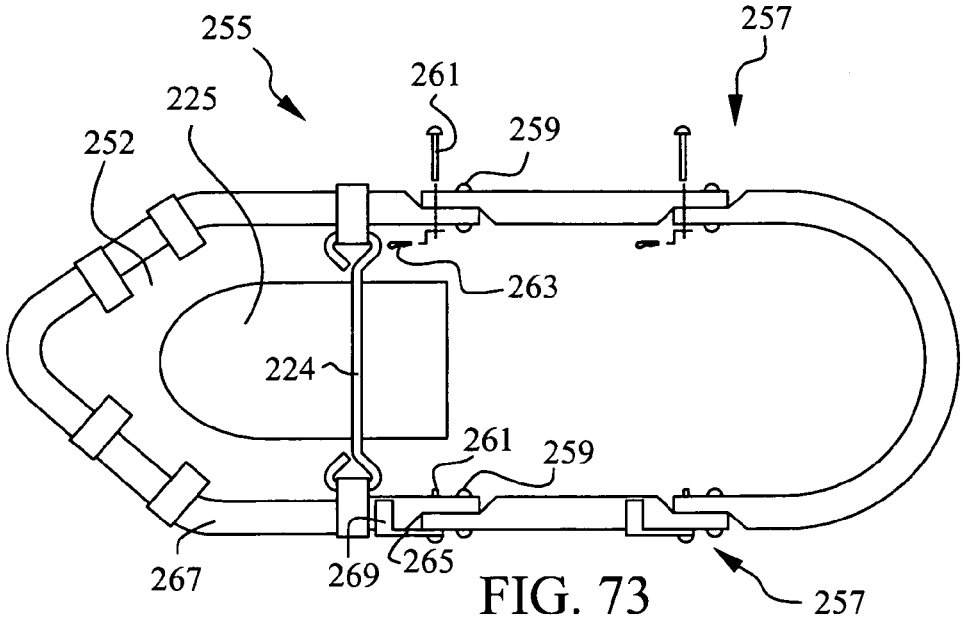
FIG. 73 is a plan view of an alternative embodiment having folding joints.

FIG. 73 illustrates a third alternative length adjustable snowshoe, generally 255. Joints 257 are adapted to fold, allowing a change in length of shoe 255 to accommodate different walking conditions, or for compact storage. Deck 252 may be flexible and bend to accommodate joint rotation, or may be provided with one or more hinges. A joint 257 may include a hinge axle 259 and a pin 261. Pin 261 may be retained in assembled position by a self-biased clip 263. Alternatively, pin 261 may be carried by and biased into position by a spring clip 265. Such a spring 265 may be affixed to a snowshoe frame 267 by attachment structure 269. In such a configuration, small parts such as pin 261 or clip 263 are unlikely to be lost.

Figure 74:
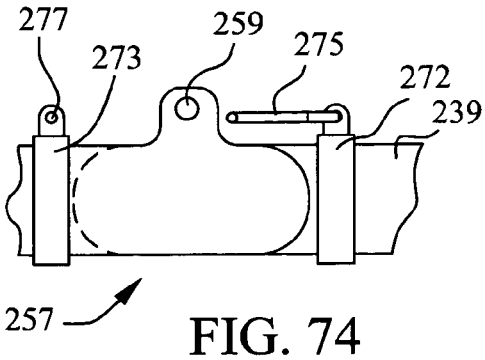
FIG. 74 is a side view in elevation of an alternative folding joint in an unlocked configuration for folding.
Figure 75:
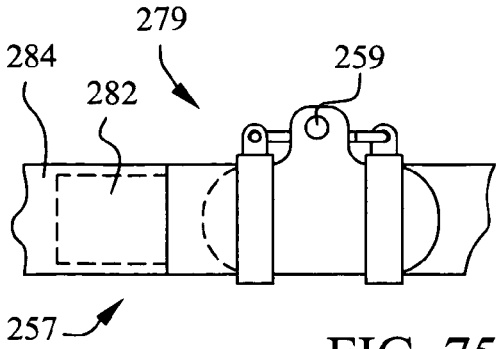
FIG. 75 is a side view in elevation of the embodiment of FIG. 74 in a locked configuration.

FIGS. 74 and 75 illustrate an alternative joint 257 suitable for use in the embodiment of FIG. 73. Rotation axle 259 is positioned to allow 180 degree rotation of the joint 257. One or more sliding locking rings 272, 273 may be positioned to resist rotation of the joint 257. As illustrated, ring 272 carries a latch hook 275 to interface with eye 277 and maintain rings 272, 273 in a locking position. Joint structure 279 may be forged from structure forming a snowshoe frame, or may be connected to a frame member as illustrated by stub end 282 in FIG. 75. Structure 279 may be attached to a snowshoe frame member 284 by welding, adhesives, mechanical fasteners, or any suitable technique.

Reducing the length of the rear portion of a snowshoe is particularly of benefit to allow "skating" down relatively steep terrain. A too long tail section substantially aligns a flotation platform with the slope and prevents a snowshoe from providing support in a horizontal position. Having the ability to make an adjustment in rear deck length virtually "on the fly" offers a significant improvement over current commercially available snowshoes.

Figure 76:
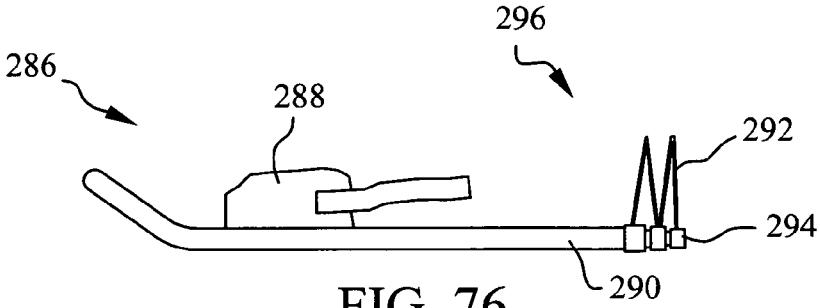
FIG. 76 is a side view of an alternative embodiment with an accordion section in a compact configuration.
Figure 77:
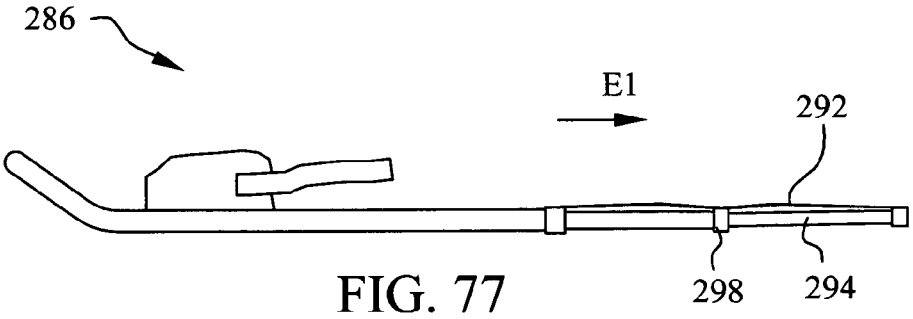
FIG. 77 is a side view of the embodiment of FIG. 76 in an expanded configuration.

FIGS. 76 and 77 illustrate a fourth alternative size adjustable embodiment of the invention, generally indicated at 286, having an accordion-like portion at a rear location. A binding 288 may be carried by a forward integrated binding/toe segment 290. The forward portion may also be adapted for changes in length in accordance with principals of this invention. In the illustrated embodiment 286, a deck portion 292 is adapted to extend, as indicated by arrow E1, and to contract with changes in position of one or more extension members 294. Any number of accordion pleats 296 may be incorporated to provide a desired range in size of a snowshoe 286. Pleats 296 are typically attached to the extension member 294 at attach structure 298.

Figure 78:
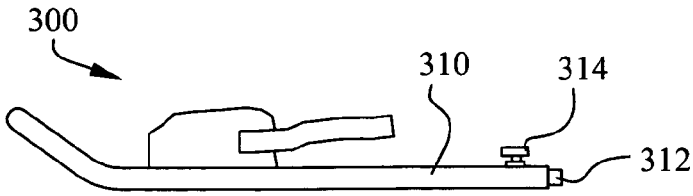
FIG. 78 is a side view of an alternative embodiment with a telescoping section in a compact configuration.
Figure 79:
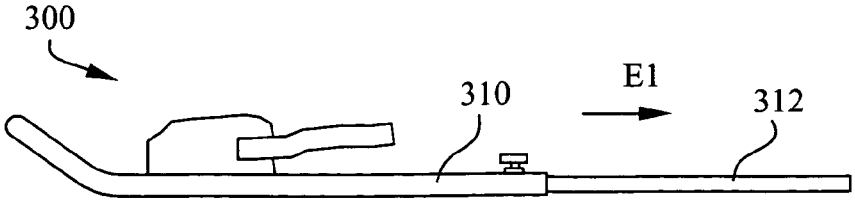
FIG. 79 is a side view of the embodiment of FIG. 78 in an expanded configuration.

FIGS. 78 and 79 illustrate a fifth length adjustable embodiment of the invention, generally indicated at 300, having a telescoping section to adjust a rear length of the 'shoe. The illustrated embodiment has a fixed deck 310, and a sliding deck portion 312. As illustrated, the sliding portion 312 is adapted to slide underneath the fixed portion 310. Alternative arrangements are also workable. A spring loaded latch 314 is illustrated for purpose of maintaining a desired length of the snowshoe 300. Sections 310 and 312 may be telescopically connected with tubular members, or any sliding arrangement. For example, it is within contemplation for rail structure depending from the bottom surface of the 'shoe 300 to be arranged as a slide mechanism. Alternatively, or in addition, either of portions 310 and 312 may be received in sliding and captured relation to the other. Such an arrangement is particularly suitable for snowshoes 300 having flotation decks made from substantially rigid materials, such as plastic.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A snowshoe comprising:

a flotation platform carrying first connection structure;

a binding comprising traction enhancing structure adapted for use independent of said flotation platform, said binding being attachable to footwear and further comprising second connection structure, said first and second connection structure cooperatively forming a quick-connect fixture operable to couple said binding to said platform while said binding is attached to said footwear; wherein:

when coupled to said platform, said binding is supported for rotation about a pivot axis substantially defined by rigid axle structure.

2. A snowshoe according to claim 1, said quick-connect fixture being reversibly operable by a user to decouple said binding and said platform while said binding is attached to footwear of said user.

3. A snowshoe according to claim 1, said quick-connect fixture being structured and arranged to effect a step-in coupling between said first and second structures.

4. A snowshoe according to claim 1, said first structure comprising a stub axle arranged for engagement with structure associated with said binding.

5. A snowshoe according to claim 4, said stub axle being configured and arranged for transverse motion between first and second positions whereby to couple and decouple said binding and said platform respectively.

6. A snowshoe, comprising:

a flotation platform having a deck portion with an opening configured to receive a binding assembly;

a said binding assembly; and quick-release connection means constructed and arranged to couple said binding with respect to said flotation platform such that said binding assembly is positioned and enabled to pivot within said opening; wherein:

when coupled to said platform, said binding is supported for rotation about a pivot axis substantially defined by rigid axle structure; and constituent components of said quick-release connection means are carried in attached combination between said binding and said platform.

7. A snowshoe according to claim 6, wherein said binding assembly includes a sole plate carrying a first component of said quick-release connection means;

said flotation platform includes structure carrying a second component of said quick-release connections means; and said first and second components are constructed and arranged to effect a pivoting connection of said sole plate with respect to said deck portion when said sole plate is positioned within said opening to bring said first and second components into coupling engagement.

8. A snowshoe according to claim 7, wherein said second component comprises an axle element and said first component comprises a mechanism structured to register with said axle element;

said quick-release connection means further comprising latching means structured to hold said first component in registration with said second component.

9. A snowshoe according to claim 7, wherein said first component comprises an axle element and said second component comprises mechanism structured to register with said axle element;

said quick-release connection means further comprising latching means structured to hold said first component in registration with said second component.

10. A snowshoe according to claim 7, wherein said second component comprises a tang element and said first component comprises a mechanism structured to register with said tang element;

said quick-release connection means further comprising latching means structured to hold said first component in registration with said second component.

11. A snowshoe comprising:

a flotation platform carrying first connection structure;

a binding comprising second connection structure, said first and second connection structure adapted cooperatively to form a quick-connect fixture whereby to couple said binding to said platform; and retaining structure carried by one connection structure and being biased to urge said retaining structure into a retaining position for cooperating structure of the other connection structure.

12. The snowshoe according to 11, said flotation platform being adjustable in size to present a plurality of footprint sizes to snow.

13. The snowshoe according to 11, said retaining structure comprising a latch.

14. The snowshoe according to 11, said retaining structure comprising a stub axle.

15. The snowshoe according to 11, said retaining structure comprising a trigger.

16. The snowshoe according to 11, said retaining structure comprising a toggling mechanism.

17. In a snowshoe in which a flotation platform includes decking anchored to tubular side supports, the improvement which comprises:

providing said flotation platform in segments, including:

a binding segment having approximately parallel tubular side supports, being constructed and arranged to support a snowshoe binding and carrying a first portion of a coupling mechanism; and at least one extension member carrying structure configured to register with terminal ends of said tubular side supports and carrying a second portion of a coupling mechanism;

a retaining mechanism carried in combination by respective flotation deck portions of said binding segment and said extension segment;

said retaining mechanism being operable to hold said binding segment and said extension segment in juxtaposed connected condition.

* * * * *